US007070185B2

(12) United States Patent
Pulkrabek

(10) Patent No.: US 7,070,185 B2
(45) Date of Patent: Jul. 4, 2006

(54) ARCHERY TARGET WITH COVERING LAYER

(75) Inventor: Larry R. Pulkrabek, Cloquet, MN (US)

(73) Assignee: Field Logic, Inc., Superior, WI (US)

( * ) Notice: Subject to any disclaimer, the term of this patent is extended or adjusted under 35 U.S.C. 154(b) by 0 days.

(21) Appl. No.: 10/706,121

(22) Filed: Nov. 12, 2003

(65) Prior Publication Data

US 2004/0140623 A1 Jul. 22, 2004

Related U.S. Application Data

(63) Continuation-in-part of application No. 10/313,184, filed on Dec. 6, 2002.

(51) Int. Cl.
*F41J 3/00* (2006.01)

(52) U.S. Cl. ..... 273/408

(58) Field of Classification Search ..... 273/403, 273/404, 407, 408

See application file for complete search history.

(56) References Cited

U.S. PATENT DOCUMENTS

| | | | | |
|---|---|---|---|---|
| 3,088,738 | A | 5/1963 | Meyer | |
| 4,076,246 | A | 2/1978 | Meyer | |
| 4,126,501 | A | 11/1978 | Croll | |
| 4,203,600 | A | 5/1980 | Brown | |
| 4,244,585 | A | 1/1981 | Croll | |
| 4,374,571 | A | 2/1983 | Hirvela | |
| 4,477,082 | A | 10/1984 | McKenzie et al. | |
| 4,643,434 | A | 2/1987 | Carlin | |
| 4,813,684 | A | 3/1989 | Bruno | |
| 4,940,244 | A | 7/1990 | Batts, III | |
| 4,983,453 | A | 1/1991 | Beall | |
| 5,055,242 | A | 10/1991 | Vane | |
| 5,286,553 | A | 2/1994 | Haraguchi et al. | |
| 5,307,584 | A | 5/1994 | Jarvis | |
| 5,465,977 | A | 11/1995 | Mann | |
| 5,498,001 | A | 3/1996 | Franks et al. | |
| 5,503,403 | A | 4/1996 | Morrell | |
| D369,631 | S | 5/1996 | Stewart et al. | |
| 5,649,708 | A | 7/1997 | Podlesny | |
| 5,865,440 | A | 2/1999 | Pulkrabek | |
| 5,910,458 | A | 6/1999 | Beer et al. | |
| 6,068,261 | A | 5/2000 | Nettle | |
| 6,080,482 | A | 6/2000 | Martin et al. | |
| 6,254,100 | B1 | 7/2001 | Rinehart | |
| 6,495,206 | B1 * | 12/2002 | Desai | 427/243 |
| 2002/0113372 | A1 | 8/2002 | Love | |
| 2002/0145256 | A1 | 10/2002 | McKenzie et al. | |

OTHER PUBLICATIONS

Printout from website: http://www.fieldlogic.com/Block_all_arrows.htm, 2 pages; Block_durability, 2 pages; Block_arrow_removal, 2 pages; Block_portable_freestanding_weatherproof, 2 pages; Oct. 31, 2002.

(Continued)

*Primary Examiner*—Mark S. Graham
(74) *Attorney, Agent, or Firm*—Faegre & Benson LLP

(57) ABSTRACT

An archery target with a covering layer and a method of making the same. One or more target elements are arranged in at least one stack. The target elements include side edges oriented toward a target face. A polymeric covering layer extends across the side edges to comprise the target face. The covering layer help retain the target elements in the stacked configuration and provides a surface for applying target indicia.

58 Claims, 16 Drawing Sheets

OTHER PUBLICATIONS

Printout from website: http://www.fieldlogic.com/Block_letter_to_range_operators.htm; 5 pages; Oct. 31, 2002.

Flyer: *The Block by Northern Whitetail*; 1998; Northern Whitetail; White Bear, Minnesota; 2 pages.

Guide: *Archery Business*; Mar./Apr. 1997; 2 pages.

Brochure: *McKenzie Targets 1997*; McKenzie Targets, Granite Quarry, NC; 7 pages.

* cited by examiner

ARCHERY TARGET WITH COVERING LAYER

The present application is a continuation-in-part of U.S. Ser. No. 10/313,184 entitled Three Dimensional Archery Target with Replaceable Target Elements, filed Dec. 6, 2002.

FIELD OF THE INVENTION

The present invention is directed to an archery target with a covering layer that extends across at least the target face. The present archery target with a covering layer can be used as a freestanding target or as an insert for a three-dimensional archery target.

BACKGROUND OF THE INVENTION

Various types of archery targets are known, including conventional three-dimensional life-size animal-simulating archery targets. Such targets have a shape resembling that of a game animal, for example, a deer or other animal. The targets may be formed in a single piece from a lightweight foam material, such as polyurethane foam. These targets are adapted for use with both broad head arrows, which comprise a plurality of intersecting razor blades tapering to a sharp point, and field point or target arrows. Critical target areas may be indicated on the target, e.g., by bull's eye markings, which are either applied onto or molded into the foam target.

Repeated arrow strikes on a foam archery target will cause the target to deteriorate. This outcome is especially true when broad head arrows are used. When a broad head arrow hits a target, the blades forming the arrowhead slice through the target material to a considerable depth. As the target material is hit repeatedly, pieces of the target are cut loose. Therefore, a target is destroyed much more rapidly with broad head arrows than with field point or target head arrows. However, even when field point or target head arrows exclusively are used, at least a portion of the target will inevitably be destroyed with repeated use.

In practice, a very large proportion of the arrow strikes on an archery target fall within a relatively small portion of the target. For example, archers will typically aim at an area of the target corresponding to vital organs of the animal which the target represents. Most archers will hit this target or bull's eye area most of the time. Therefore, this target area will be destroyed rapidly, due to repeated arrow strikes, while most of the remaining target remains relatively undamaged. The functional life of a three-dimensional life-size animal simulating archery target may be extended, and the cost of using such a target reduced, by making replaceable a target section of the archery target which is likely to be destroyed rapidly due to repeated arrow strikes.

Instead of forming the target from a single piece of molded foam, a three-dimensional life-size animal simulating archery target may be molded in multiple pieces, which are detachably joined together to form the target, such as disclosed in U.S. Pat. No. 4,477,082 (McKenzie, et al.). As one piece of the target is destroyed by repeated arrow strikes, this section alone may be replaced, eliminating the need to replace the entire target. Thus, the life of the target is extended, and the operating cost thereof reduced. The replaceable target section in McKenzie is approximately one-third of the total target. Thus, it is relatively expensive to replace. Further, the vertical dovetails holding the body sections together tend to come apart with repeated arrow strikes, due to the dynamic force of arrows impacting the target.

Another known three-dimensional life-size animal-simulating archery target is described in U.S. Pat. No. 5,503,403 (Morrell). This archery target includes a foam body, which may be formed of front and rear body sections connected together by a dovetail joint structure. The foam body includes a target insert receiving recess into which a target insert is placed. The target insert may be filled with packing material, such as cotton molt, for use with only target arrows, or may be formed of foam, for use with both broad head and target arrows. The target insert may be held in place in the recess using straps and wire. A body cover, which may be made of cloth, or molded in foam, is used to cover the removable and replaceable target insert.

U.S. Pat. No. 6,254,100 (Rinehart) discloses an archery target having a target section aperture formed therein and a replaceable target section adapted to fit in the target section aperture. The replaceable target section is held in place in the target section aperture by one or more support rods extending through support rod apertures formed in the body section and the replaceable target section. The support rods may also extend into other target body sections, to hold the target body sections together to form a structurally stable archery target. A replaceable target insert may be positioned in a target insert aperture formed in the replaceable target section. Arrowheads can be damaged or destroyed if they strike the metal support rods. Broad heads either become trapped in the target insert or will cause tear out with relatively few shots.

BRIEF SUMMARY OF THE INVENTION

The present invention relates to an archery target with a covering layer on one or more of the target faces. One or more target elements are arranged in at least one stack. The target elements comprise side edges oriented toward a target face. A polymeric covering layer extends across the side edges to comprise the target face. The covering layer helps retain the target elements in the stacked configuration and provides a surface for applying target indicia.

The archery target can have a plurality of target faces. In one embodiment, the covering layer substantially surrounds the stack of target elements. In one embodiment, the polymeric covering layer substantially surrounds the side edges of the target elements to form a plurality of target faces. The polymeric covering layer can optionally provide a compressive force on the target elements.

The covering layer can have a generally uniform or a variable thickness relative to the side edges of the target elements along the target face. In one embodiment, the covering layer comprises a first thickness relative to the side edges of the target elements along a first target face and a second thickness along a second target face. The side edges of the target elements adjacent to the target face can have a generally planar or a curvilinear configuration.

In one embodiment, the target elements comprise two discrete stacks of target elements substantially surrounded by the covering layer. The discrete stacks of target elements preferably comprise one or more different materials and different shapes. In one embodiment, the first discrete stack of target elements is adjacent to a first target face and the second discrete stack of target elements is adjacent to a second target face.

The target elements optionally comprise a plurality of generally planar foam target elements. The target elements can optionally have reduced profile edges. The target elements can be a foam material having a density selected in the range of about 2 pounds per square foot to about 10 pounds per square foot.

The covering layer is preferably a compliant, deformable and resilient polymeric material. In one embodiment, the covering layer is a foam material. The covering layer can optionally include a reinforcing structure. The covering layer preferably has a thickness of at least 0.25 inches, and more preferably at least one inch. The covering layer is preferably compatible with the material of the target elements. In one embodiment, the covering layer is a self-healing material. In another embodiment, the covering layer is a homogeneous material. The covering layer can be a molded, encapsulating layer, a liquid coating applied to the stack of target elements, or a sheet material bonded to the stack of target elements. The covering layer can be one of a foam, a film, a non-woven web, a liquid coating, or a combination thereof. Straps can optionally be used to compress the target elements.

In one embodiment, the archery target can be a free standing archery target. In another embodiment, the archery target is part of an archery system, such as an insert for a three-dimensional archery target. The three-dimensional archery target typically includes a chamber with first and second generally opposing surfaces adapted to apply a compressive force to the target elements. The compressive force is optionally applied to the target elements by a cover attached to a body segment of the three-dimensional archery target. In another embodiment, one or more displacement mechanisms apply a compressive force to the archery target. The chamber preferably includes at least one surface adapted to mechanically couple with the archery target. The three-dimensional archery target typically simulates an animal.

The present invention is also directed to a method of making an archery target. The method includes arranging one or more target elements in a generally stacked configuration. The target elements comprise a plurality of side edge oriented toward a target face. A polymeric covering layer is located across the side edges and comprises the target face.

The covering layer can be applied with a uniform or a variable thickness relative to the side edges of the target elements along the target face. The side edges of the target elements can be arranged adjacent to the target face in a generally planar or curvilinear configuration. The present method includes arranging two discrete stacks of target elements in the archery target. The discrete stacks of target elements can be one or more different materials or different shapes. Each stack is preferably positioned adjacent to a different target face.

The target elements can be a plurality of generally planar foam elements. The method includes optionally deforming the side edges of the target elements to create reduced profile side edges. The covering layer is preferably a foam material. The method includes locating a reinforcing structure in the covering layer.

The covering layer can be molded around the stack of target elements. In another embodiment, the covering layer is a liquid applied to the stack of target elements. The method also includes bonding a polymeric sheet material to the stack of planar target elements and sealing any seams on the sheet material. The archery target can optionally be subjected to heat and/or pressure in order to create or to increase the compressive force on the target elements.

DETAILED DESCRIPTION OF THE INVENTION

Figure 1:
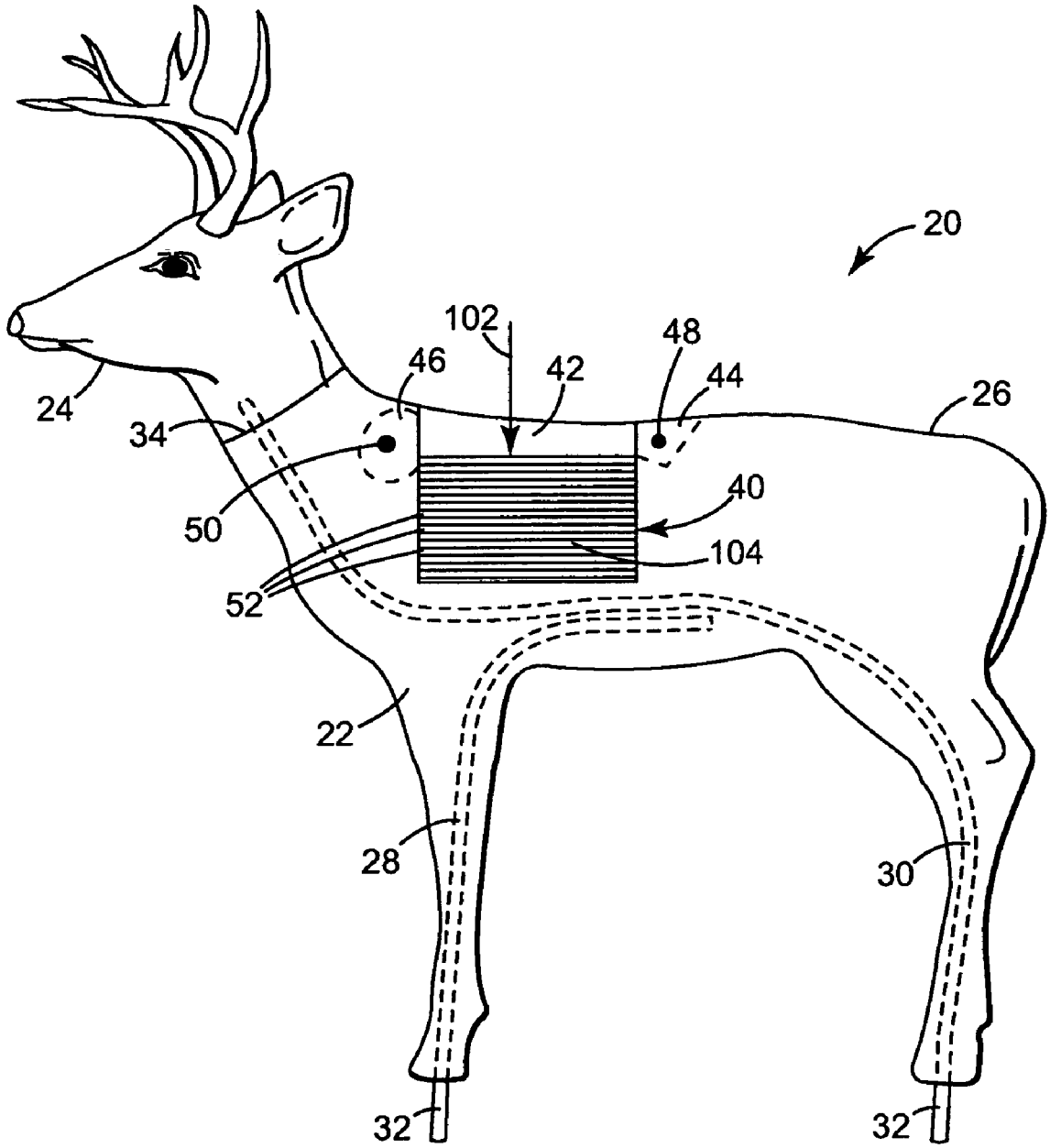
FIG. 1 is a side sectional view of a three-dimensional archery target in accordance with the present invention.

FIGS. 1 through 4 illustrate various aspects of an exemplary three-dimensional archery target 20 in accordance with the present invention. An archery target in accordance with the present invention is preferably formed in the shape and size of a game animal. For example, the three-dimensional archery target 20 of FIGS. 1–4 is formed in the shape and size of a deer.

An archery target in accordance with the present invention can be constructed from one or more body segments, depending on a variety of factors, such as cost, size of the animal being simulated, the posture of the animal, and a variety of other factors. In the embodiment illustrated in FIG. 1, the three-dimensional archery target 20 includes a first body segment 22 and a second body segment 24. The first body segment 22 illustrates the torso and legs of a deer. The second body segment 24 is the head of the deer.

The body segments 22, 24 can be constructed from a variety of natural and synthetic materials, such as wood, paperboard, polymeric materials, such as plastics, foams, non-woven materials, and the like. The body segments 22, 24 can be solid or hollow, depending upon the material from which they are constructed.

Polyurethane foam materials are preferred because of the low cost, ease of molding using conventional molding techniques, lightweight, and durability. Polyurethane foam is a semi-rigid material that can be deformed slightly, but retains that deformed shape instead of returning to its original shape. Polyurethane foam with a density of about 10 pounds per square foot to about 50 pounds per square foot is preferred. When a broad head arrow tip impacts polyurethane foam, the blades of the points enter the foam causing a x-shaped cut. The foam cuts cleanly rather than being deformed and does not close around so the arrow is generally easy to withdraw. Outer surface 26 of the body segments 22, 24 is preferably coated with a material to seal the foam against moisture, to protect it from UV degradation, and give the target a lifelike appearance.

A variety of reinforcing members 28, 30 are preferably molded into the body segments 22, 24. The reinforcing members 28, 30 can be a variety of materials, such as metal, plastic or composite materials. Metal tubing provides a high degree of rigidity, but can damage an arrow tip that strikes it. Plastic tubing is typically less rigid, but is not as likely to damage the arrow tip.

In one embodiment, the reinforcing members 28, 30 extend beyond the bottom of the body segment 22 to provide anchors 32. The anchors 32 can be driven into the ground or attached to a base in order to support the archery target 20. In an alternate embodiment, metal stakes or other supporting structures are inserted into the optionally hollow reinforcing members 28, 30 to support the archery target 20.

In the illustrated embodiment, the reinforcing member 30 extends all the way into a portion of the second body segment 24 so as to increase the strength at the junction 34. The material and configuration of the reinforcing members 28, 30 can vary with the size and shape of the present three-dimensional archery target and a variety of other factors.

Figure 2:
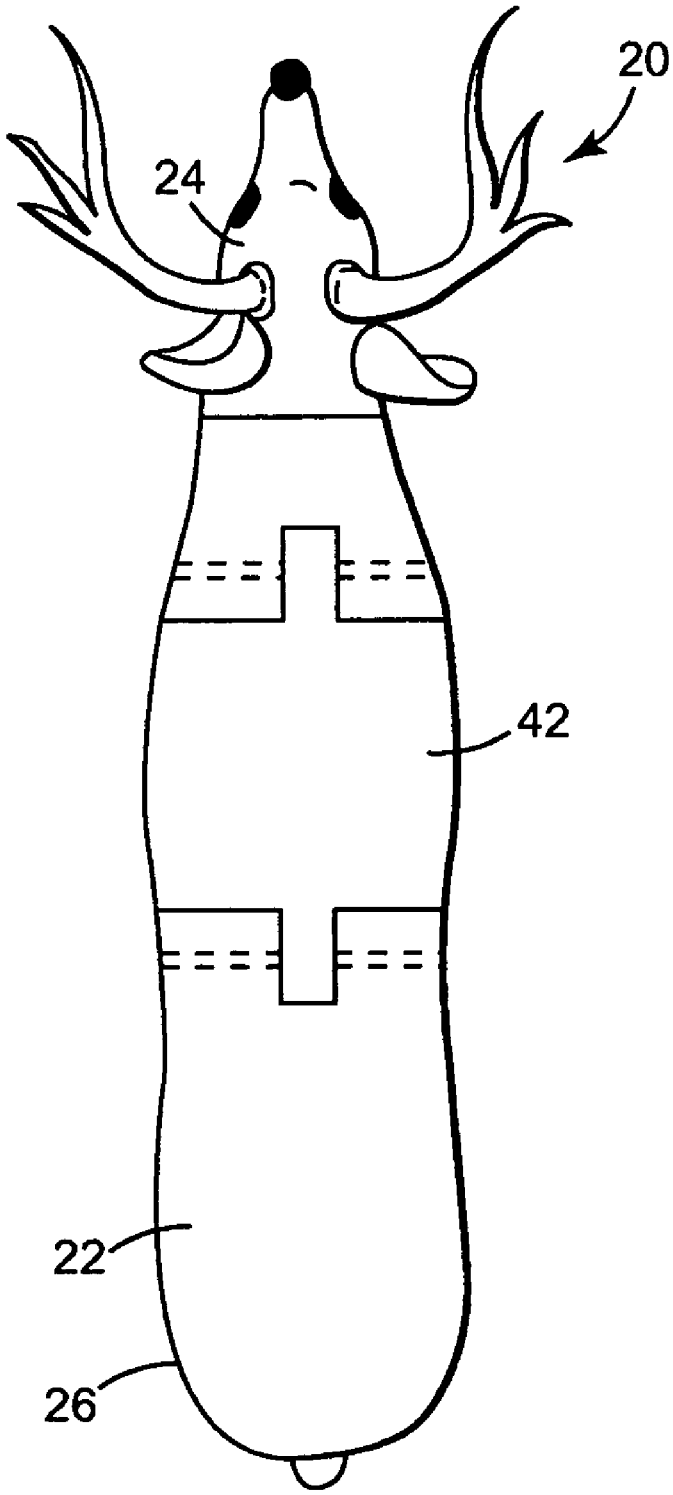
FIG. 2 is a top view of the three-dimensional archery target of FIG. 1.

As best-illustrated in FIGS. 1 and 2, the three-dimensional target 20 includes a replaceable target assembly 40 located in the region of the vital organs of the animal simulated. In the illustrated embodiment, the replaceable target assembly 40 includes a plurality of generally planar target elements 52 arranged so that side edges comprise a target face 104. In another embodiment, the replaceable target assembly 40 includes a single target element, such as a block of foam, that extends substantially across apertures 94, 96 of the archery target 20. As used herein, a "replaceable target assembly" refers to one or more target elements pre-configured to function as an archery target with or without the present three-dimensional archery target.

Figure 3:
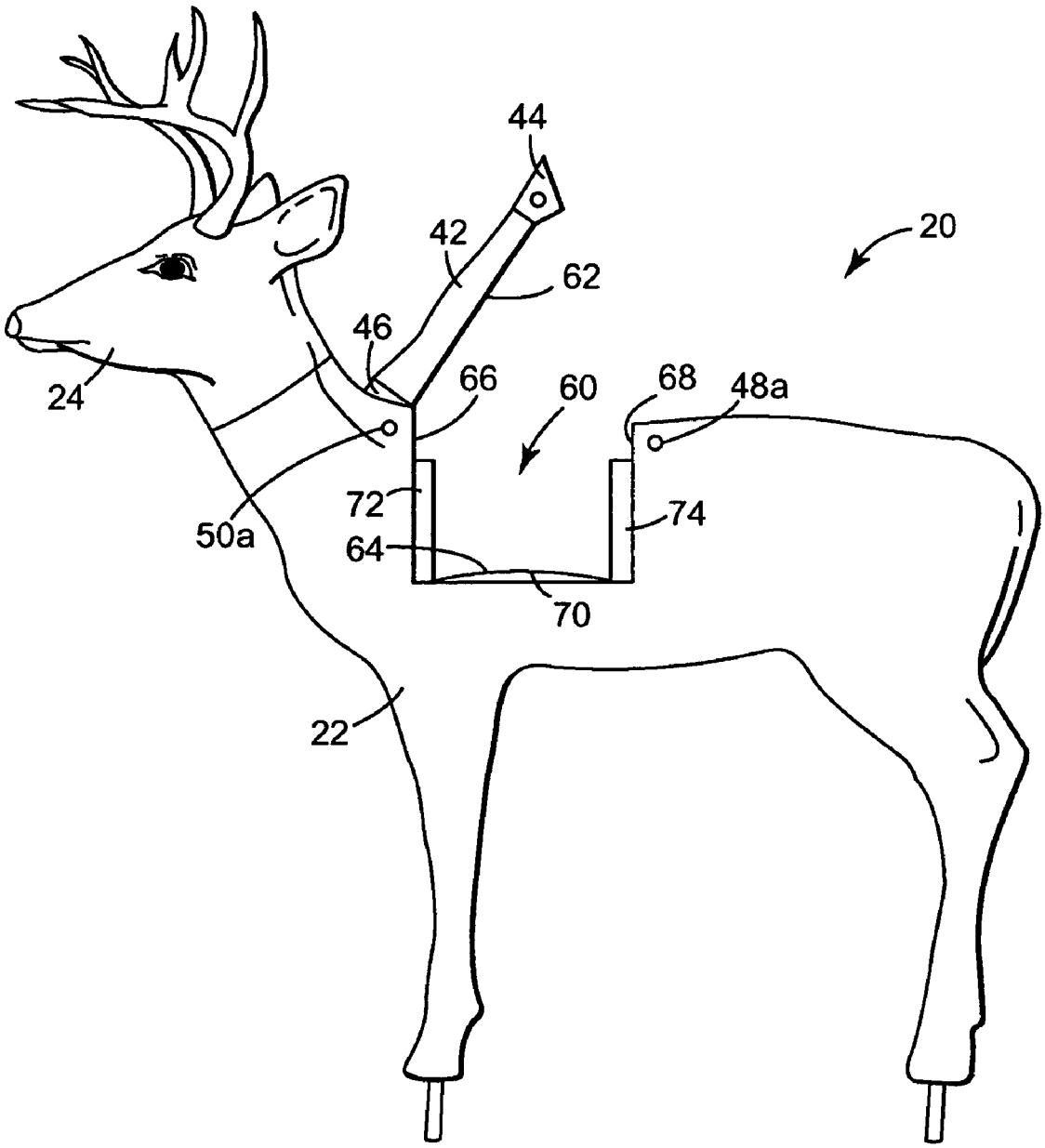
FIG. 3 illustrates a method of installing target elements in the three-dimensional archery target of FIG. 1.
Figure 4:
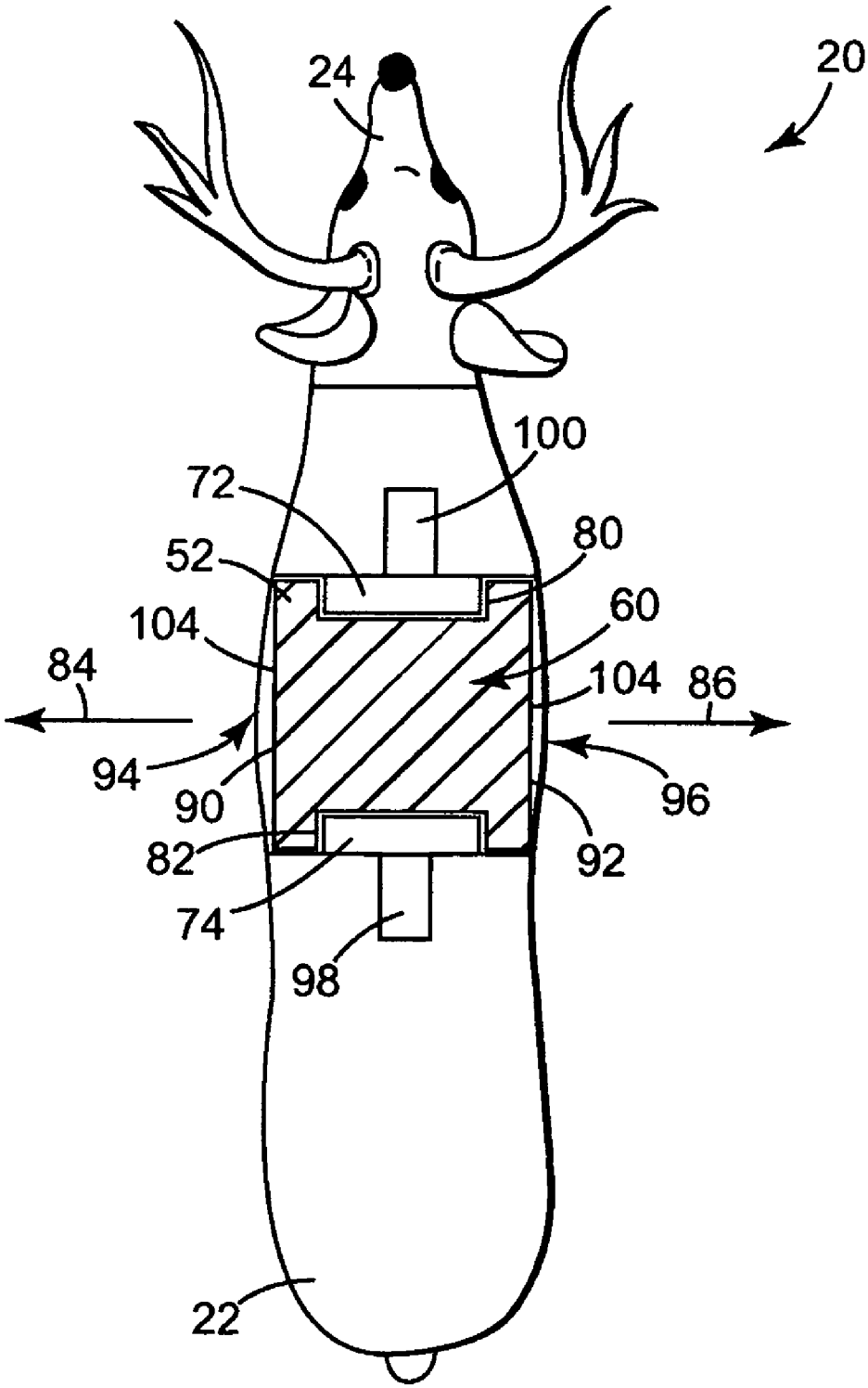
FIG. 4 is a top view of the three-dimensional archery target of FIG. 1 with the cover removed.

As best-illustrated in FIGS. 3 and 4, the replaceable target assembly 40 is located in a chamber 60 formed in the first body segment 22. The chamber 60 preferably extends through the entire width of the first body segment 22 so that the replaceable target assembly 40 is accessible from either side of the archery target 20.

In the illustrated embodiment, the chamber 60 is bounded on four sides. Lower surface 62 of cover 42 forms a top surface of the chamber 60. Lower surface 64 and side surfaces 66, 68 form the other three surfaces of the chamber 60. In the illustrated embodiment, the cover 42 applies a compressive force 102 to the major surfaces of the target elements 52. The compressive force 102 is opposed by the lower surface 64. The lower surface 64 can optionally include a camber or non-planar structure 70 which serves to increase or concentrate the compressive force 102 in the center of the target face 104.

FIG. 4 is a top view of the archery target 20 with the cover 42 removed. In the illustrated embodiment, the target elements 52 have a pair of recesses 80, 82, which mechanically couple with structures 72, 74 on the side surfaces 66, 68 of the chamber. The combination of the recesses 80, 82 and the structures 72, 74 resist movement of the target elements 52 in the directions 84, 86. This arrangement is desirable because the force of an arrow striking the archery target 20 or an arrow being removed from the archery target 20 will fall generally along the directions 84, 86.

As used herein, "mechanically coupled" refers to interengaging structures on target elements and an archery target that resist displacement of target elements relative to an archery target due to an arrow strikes or an arrow being removed. Mechanical coupling does not require a tight mechanical fit between the interengaging structures. A gap may exist between some of the surfaces of the interengaging structures, such as illustrated in FIGS. 4 and 5*a*–5*f*. The gap facilitates installation and removal of the target elements from the chamber. FIG. 4 illustrates an embodiment where the target element 52 has a shape complementary to the structures 72, 74 (see also FIGS. 5*a*–5*f*). As will be illustrated in FIGS. 5*a*–5*f*, the target elements 52 of the present invention can assume a wide variety of shapes, with or without features that mechanically couple with the chamber 60 in the body segment 22.

Figure 6:
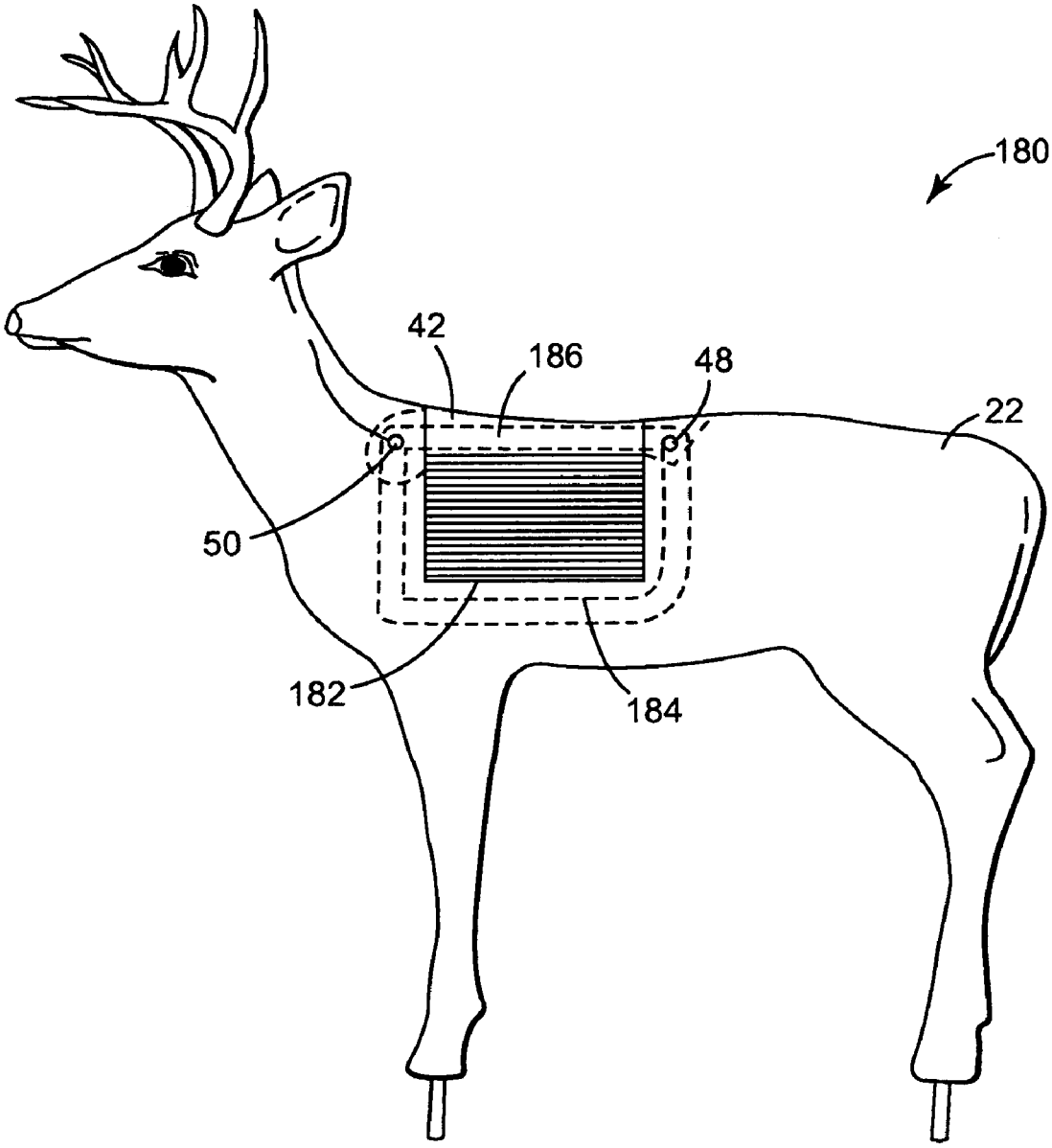
FIG. 6 illustrates a reinforcing structure for a replaceable target assembly in accordance with the present invention.

The method of the present invention includes positioning a plurality of the target elements 52 in the chamber 60. Side edges 90, 92 of the target elements 52 are accessible through first target aperture 94 and second target aperture 96, respectively. The cover 42 is then replaced so that cover anchor 44 is located in recess 98 and cover anchor 46 is located in recess 100. Pins 48, 50 are replaced in holes 48*a*, 50*a*, respectively, so that the cover 42 is securely attached to the first body segment 22. In one embodiment, a reinforcing member is molded into the cover 42 (see FIG. 6). The reinforcing member preferably extends under the pins 48, 50. In the embodiment of FIG. 6, the pins 48, 50 pass through the reinforcing member.

In the illustrated embodiment, the cover 42 applies a compressive force 102 to the target elements 52. The compressive force 102 can be increased or decreased by increasing or decreasing the number of target element 52 located in the chamber 60. The compressive force 102, either alone or in combination with the mechanical coupling of the structures 72, 74 with recesses 80, 82 releasably retain the target elements 52 in the first body segment 22. The side edges 90, 92 of the target elements 52 form the target face 104 located generally where the vital organs of the animal simulated by the archery target 20 are located.

The replaceable target assembly 40 can be repaired by removing the compressive force 102 and replacing some or all of the target elements 52. In many situations, the replaceable target assembly 40 can be restored to essentially perfect condition by replacing less than all of the target elements 52.

The ability to replace individual target elements 52 significantly reduces the cost of maintaining the archery target 20 in working condition.

The target elements 52 are preferably constructed from a foam material, such as disclosed in U.S. Pat. No. 5,865,440 (Pulkrabek), which is incorporated by reference. The foam is weather resistant and can be used either indoors or outdoors. In one embodiment, the foam is compressed to about 70% to about 20% of its uncompressed thickness. In another embodiment, the foam is compressed to about 50% to about 5% of their uncompressed thickness. For high density foam that is not easily compressed, a compressive force of about 5-pounds/square foot or greater is typically used. Other materials, such as corrugated cardboard, softwoods in either solid form or layered structures such as plywood, and materials made from natural or synthetic fibers can also be used for the target elements 52. In another embodiment, the target elements 52 are constructed from a woven or a non-woven polymeric material.

As used herein, "target element" refers to a material adapted to be located in a chamber of an archery target. The target element can be a sheet material with an edge that forms a portion of a target face. Each layer in the replaceable target assembly can be discrete target elements or a larger piece of sheet material folded in a serpentine manner to arrange multiple edges into a target face. The larger piece of sheet material can optionally be die cut to facilitate folding. In another embodiment, the plurality of planar target elements discussed above can be replaced by a single continuous structure or material that extends across a portion of the target aperture in the three-dimensional archery target 20. For example, the target element 52 can optionally be a single piece of foam that extends substantially across the apertures 94, 96. Although the embodiments illustrated in the Figures show the edges of the target elements co-planar, it is possible for the replaceable target assembly to have a non-planar target face.

In one embodiment, the target elements 52 are about ⅛ inch to about ¼-inch thick cross-linked foam. Cross-linked foam exhibits greater self-healing at each puncture hole and provides longer target life, especially when the target is used with arrows having broad head or expandable tips. The combination of relatively thin target elements 52 and the type of foam produce very little compression about the arrow shaft and head. The foam also prevents the arrow from turning during removal, which assures that broad heads follow the same hole on ingress and egress, without tearing. Arrows are therefore easily withdrawn without resort to arrow gripping devices or excessive arm, shoulder or tugging body movement.

The foam may be open or closed cell, although a closed cell polyethylene foam is preferred. Close celled foam is less susceptible to the intrusion of moisture and deterioration from ultraviolet rays. A variety of foam materials, such as polyethylene or polyurethane foams or blends thereof may also be used to advantage. The foam preferably has a density of about 2 pounds per square foot to about 10 pounds per square foot. In contrast to higher density foam materials, it is believed the low-density material facilitates arrow removal without the friction or adherence of the layered material to the arrow that is exhibited by higher density and continuous pour foam targets. The weight of the archery target 20 is also reduced when using a low density foam and which is advantageous for the archer who wants to transport a target to his or her hunting camp.

Figure 5A:
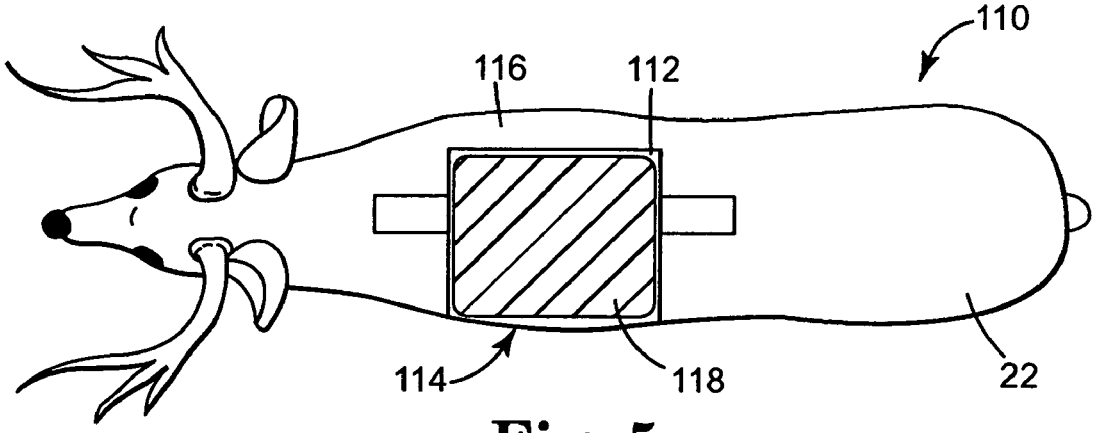
FIGS. 5*a* through 5*f* illustrate various chambers for retaining target elements in a three-dimensional archery target in accordance with the present invention.

FIG. 5*a* is a top view of a three-dimensional archery target 110 having a chamber 112 with a single target aperture 114. FIG. 5*a* illustrates a major surface of target element 118. Portion 116 of the first-body segment 22 forms a backstop that serves to retain target elements 118 in the chamber 112 and to prevent arrows from penetrating completely through the body portion 22. The target element 118 can be one of a plurality of planar members or a single structure that substantially fills the chamber 112.

Figure 5B:
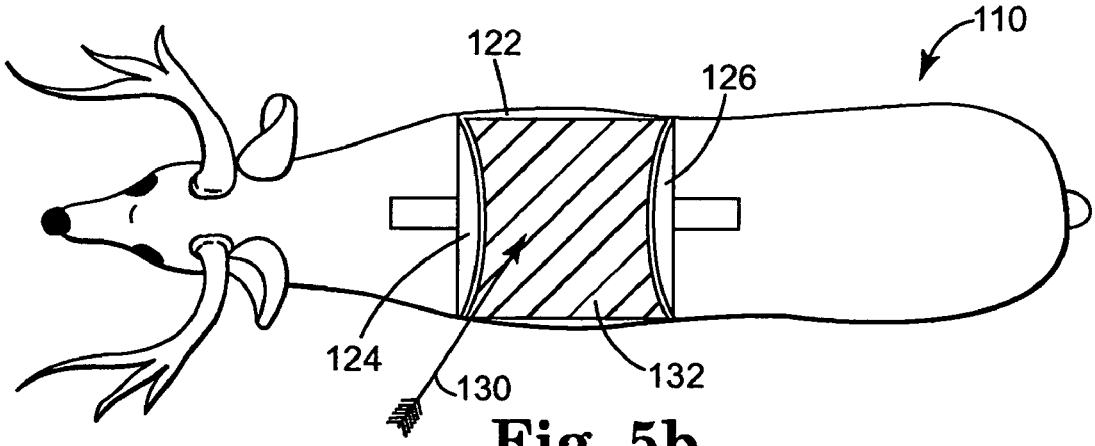

FIG. 5*b* is a top view of a three-dimensional archery target 120 with an alternate chamber 122 including curved structures 124, 126 adapted to mechanically couple with the target elements 132. The curved structures 124, 126 also serves to deflect arrows 130 towards the center of the chamber 122.

Figure 5C:
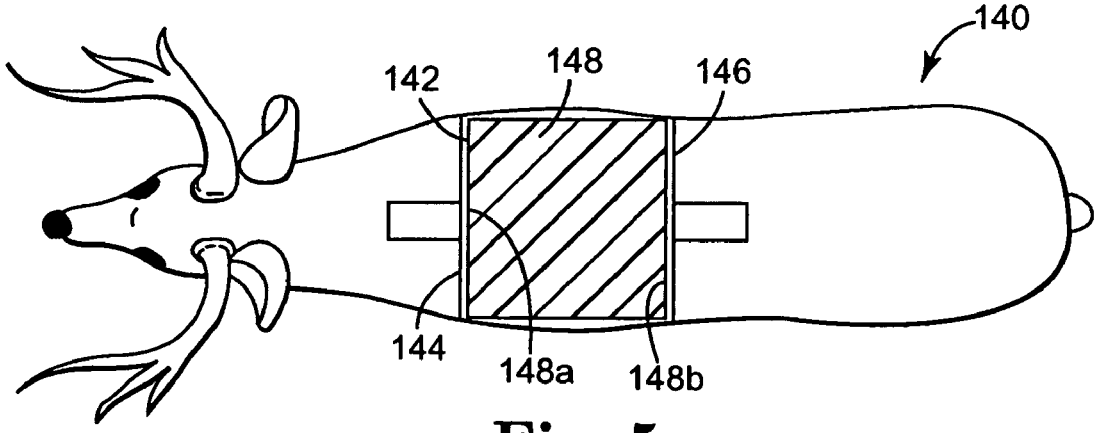

FIG. 5*c* is a top view of a three-dimensional archery target 140 having a chamber 142 with no structure for mechanically coupling with the target elements 148. Rather, the target elements 148 are retained in the chamber 142 by friction, such as along side edges 148*a*, 148*b* of the target element 148 and the side surfaces 144, 146 of the chamber 142. In another embodiment, frictional forces are applied to the target elements 148 by the lower surface of the cover and the lower surface of the chamber (see e.g., FIG. 3).

Figure 5D:
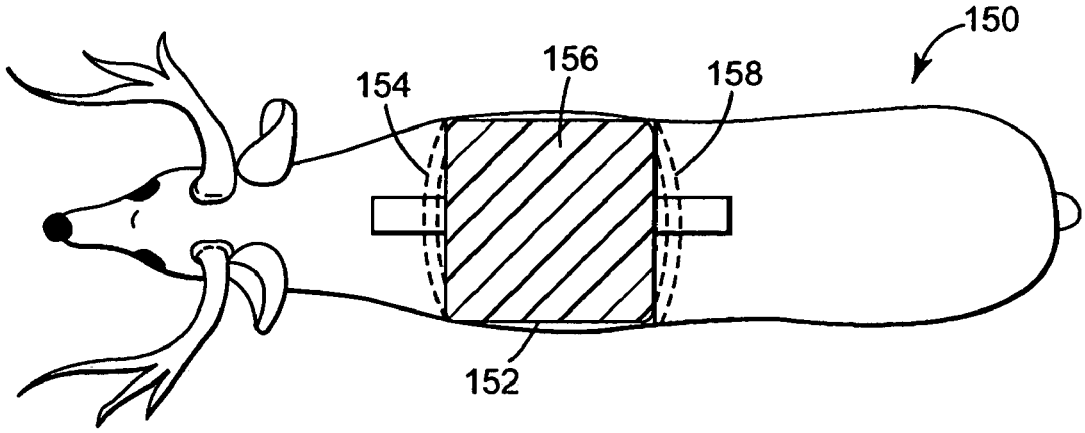

FIG. 5*d* is a top view of an archery target 150 in which the chamber 152 includes a pair of opposing concave recesses or undercuts 154, 158 adapted to mechanically couple with target elements 156. The undercuts 154, 158 extend into the body segment a sufficient amount to retain the target element 156 in the archery target 150. In an embodiment where the target element 148 is a single piece of material, the target element is preferably constructed from a resilient material, such as foam, that will return to substantially its original shape after being deformed to engaged with the undercuts 154, 158.

Figure 5E:
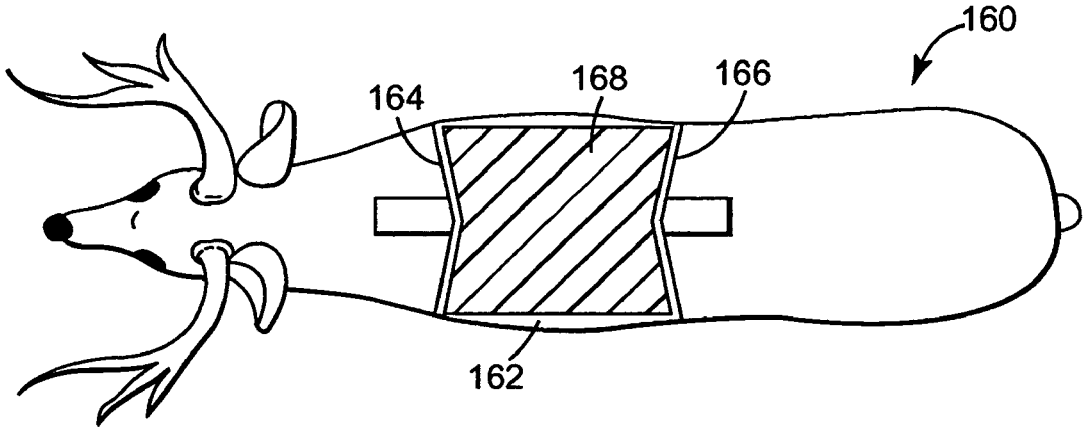

FIG. 5*e* is a top view of an archery target 160 having a chamber 162 with tapered sidewalls 164, 166. The tapered sidewalls serve to direct arrows towards the center of the chamber 162. The target elements 168 preferably have corresponding tapers to mechanically couple with the sidewalls 164, 166.

Figure 5F:
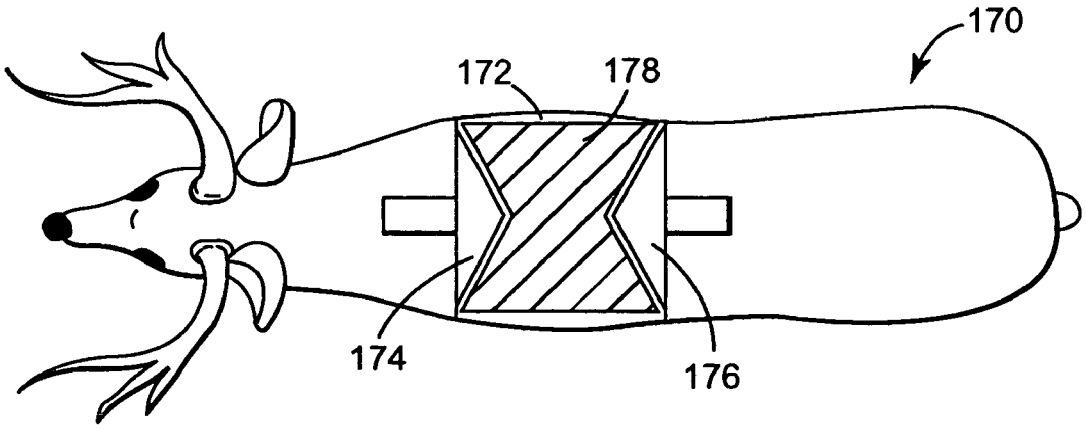

FIG. 5*f* is a top view of an archery target 170 having a chamber 172 with a pair of opposing tapered structures 174, 176. The tapered structures 174, 176 mechanically couple with corresponding tapers in the target elements to retain the target elements 178 in the chamber 172.

FIG. 6 is a side view of an alternate three-dimensional target 180 in which the chamber 182 is substantially surrounded by lower reinforcing member 184 and upper reinforcing member 186. The lower reinforcing member 184 is molded into the first body segment 22. The upper reinforcing member 186 is molded into the cover 42. In the illustrated embodiment, the pins 48, 50 preferably engage with the distal ends of the reinforcing members 184, 186. Consequently, the replaceable target assembly 40 is completely surrounded by an interlinked reinforcing structure that provide a substantial compressive force on at least the major surfaces of the target elements 52.

Figure 7:
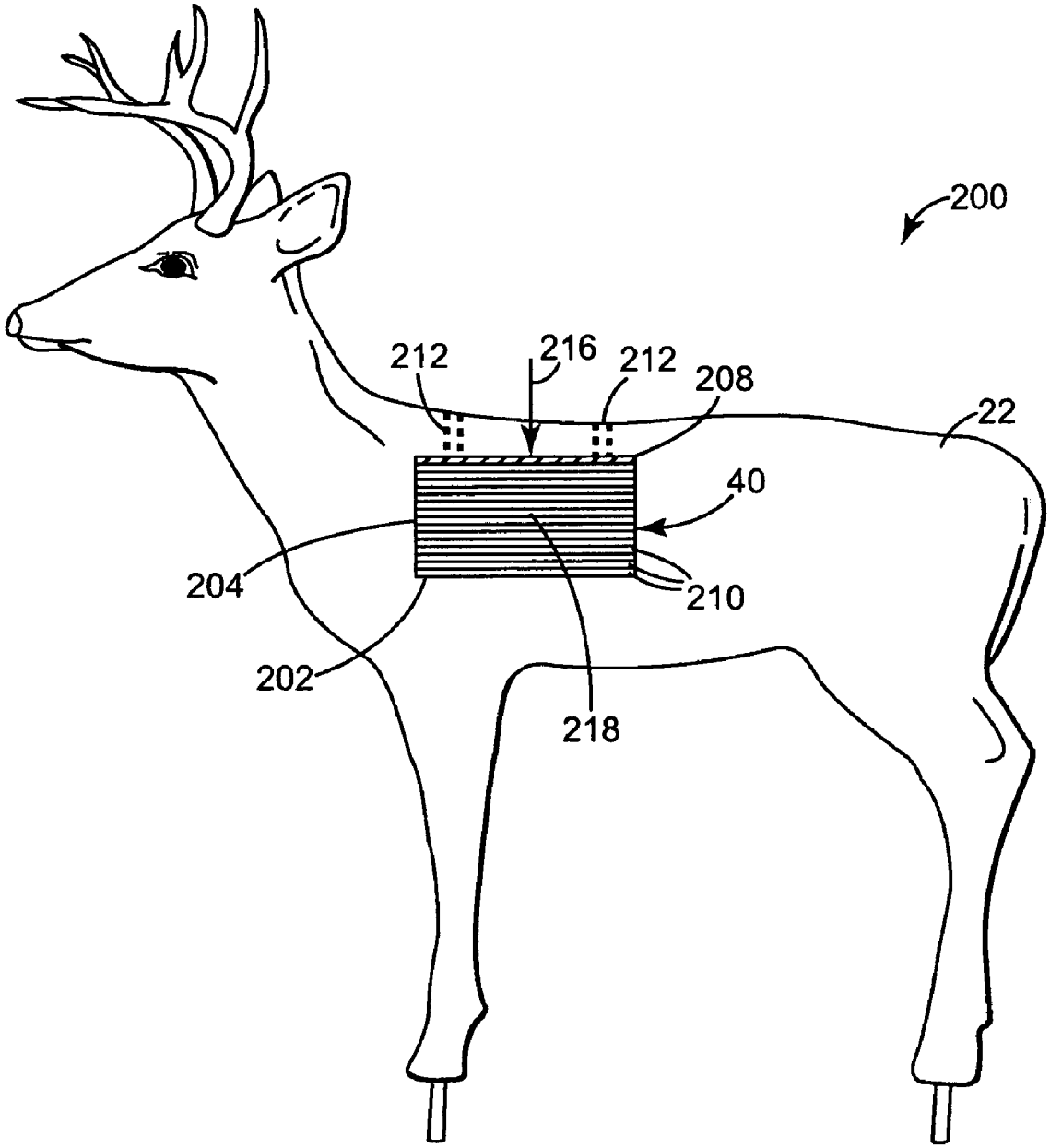
FIG. 7 illustrates a mechanism for compressing the target elements in an archery target in accordance with the present invention.
Figure 8:
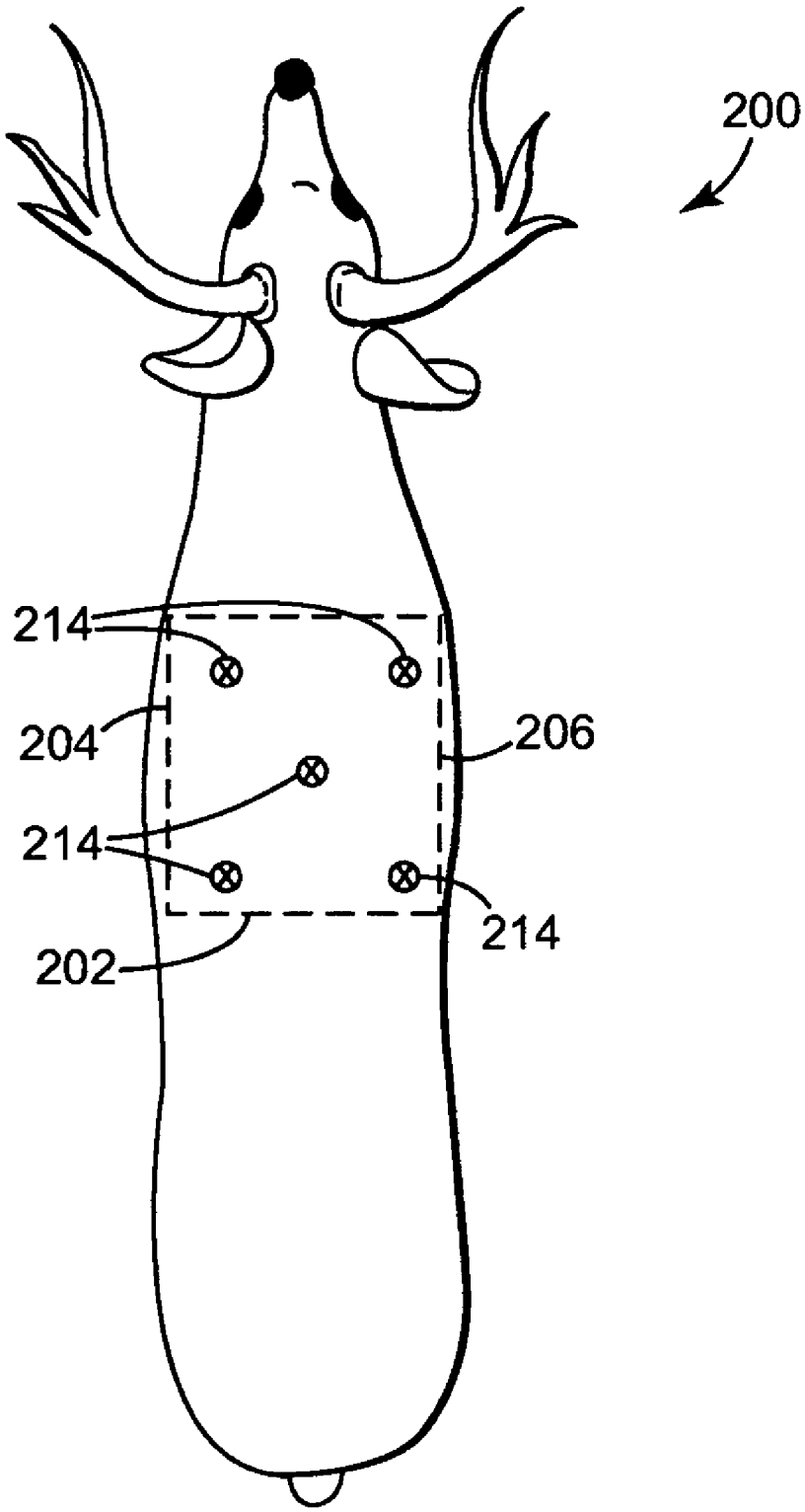
FIG. 8 is a top view of the archery target of FIG. 7.

FIGS. 7 and 8 illustrate an alternate three-dimensional target 200 in which chamber 202 for receiving the replaceable target assembly 40 is completely surrounded by the material forming the first body segment 22. In one embodiment, replaceable target assembly 40 is slid into the chamber 202 through one of the target apertures 204, 206.

In one embodiment, plate 208 is located on top of the stack of target elements 210. The plate can be any rigid or semi-rigid material capable of transmitting a compressive force to the target elements 210, such as wood, plastic, metal or composites thereof. Wood and plastic are preferred because an arrow tip striking a metal plate would likely be damaged.

In one embodiment, displacement mechanisms 212 are provided to displace the plate 208 into a compressive relationship with the target elements 210. The illustrated displacement mechanisms 212 are threaded members embedded in the first body segment 22. As best illustrated in FIG. 8, adjustment points 214 are located along the top of the archery target 200. The user can adjust the compressive force 216 applied to the major surface of the target elements 210 by turning one or more of the adjustment points 214. The compressive force 216 is opposed by the lower surface of the chamber 202. Providing a plurality of adjustment points permits the force 216 to vary in different locations along the target face 218.

In another embodiment, the displacement mechanisms 212 are an integral part of the plate 208. For example, the plate 208 could be two plates with a scissors mechanism or cam structure adapted to displace one plate relative to the other.

In another embodiment, the displacement mechanisms 212 are eliminated and the plate 208 is a wedge shaped member that is pushed into the chamber 202 through one of the target apertures 204, 206 after the target elements 210 are in place. The wedge shape of the plate 208 creates the compress force 216 on the target elements 210 located in the chamber 202. A pair of wedge shaped plates 208 simultaneously forced into both target apertures 204, 206 is preferred. The opposing forces applied to the opposing wedge shaped members serve to minimize movement or shifting of the target elements 210 in the chamber 202.

The wedge shaped plates 208 can be located on the top, the bottom, or anywhere in the stack of target elements 210. In one embodiment, the wedge shaped plate 208 is constructed from a high density foam that can be inserted anywhere in the stack of target elements 210. The compressive force 216 can be increased by increasing the number of wedge shaped plates 208 inserted into the stack of target elements 210 and/or by increasing the number of target elements 210 in the chamber 202.

Figure 13:
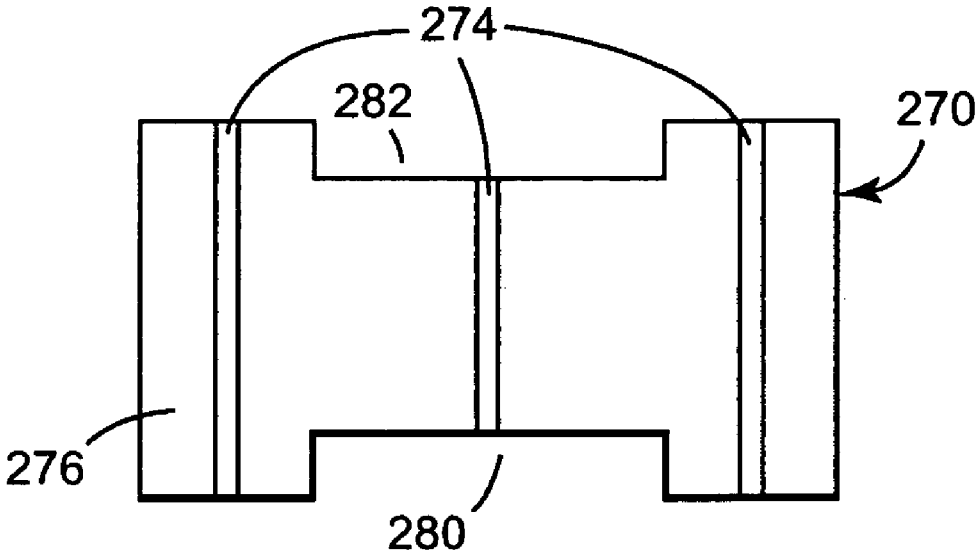
FIG. 13 is a top view of a replaceable target assembly in accordance with the present invention.
Figure 14:
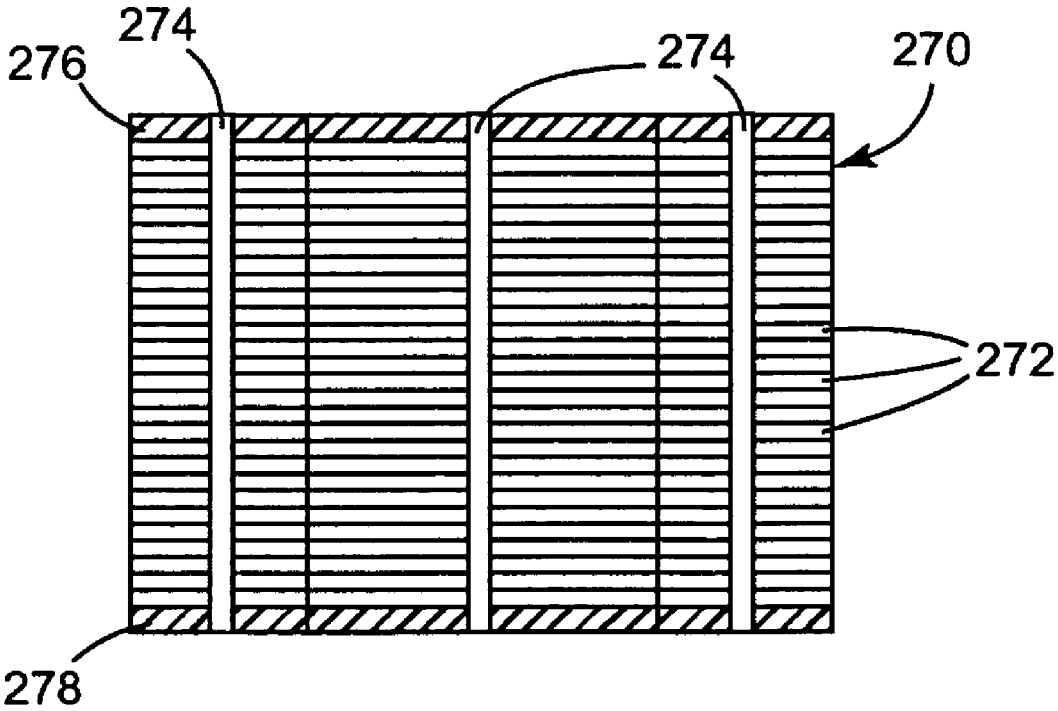
FIG. 14 is a side view of the replaceable target assembly of FIG. 13.
Figure 15:
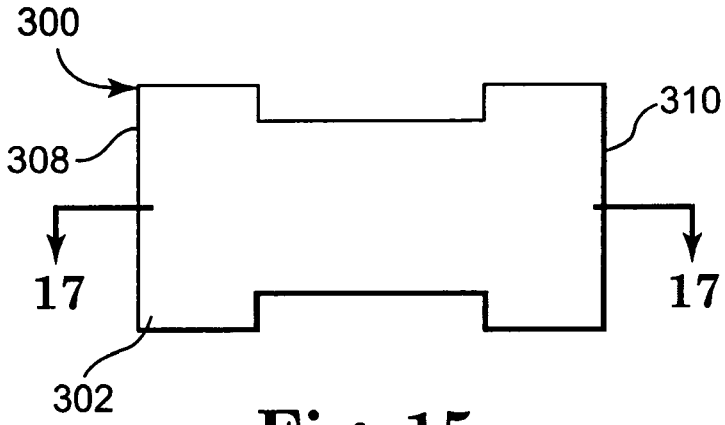
FIGS. 15 and 16 are top and front views of an alternate replaceable target assembly in accordance with the present invention.
Figure 16:
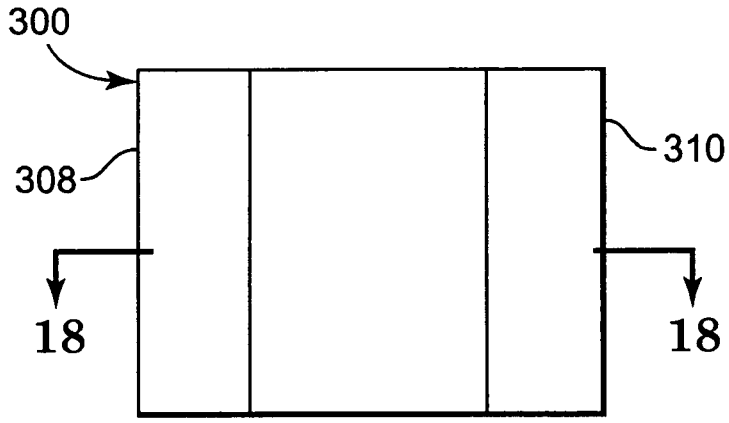

In yet another embodiment, a replaceable target assembly, such as the replaceable target assembly 270 in FIGS. 13 and 14, is slid into the chamber 202 through one of the target apertures 204, 206. The shape of the target elements 272 can vary from that disclosed in FIG. 13. The displacement mechanisms 212 are preferably treaded members that can be advanced to engage with the replaceable target assembly 270 to retain it in the chamber 202. Any of the embodiments of FIGS. 7 and 8 can be used with target elements oriented vertically or a variety of other angles.

Figure 9:
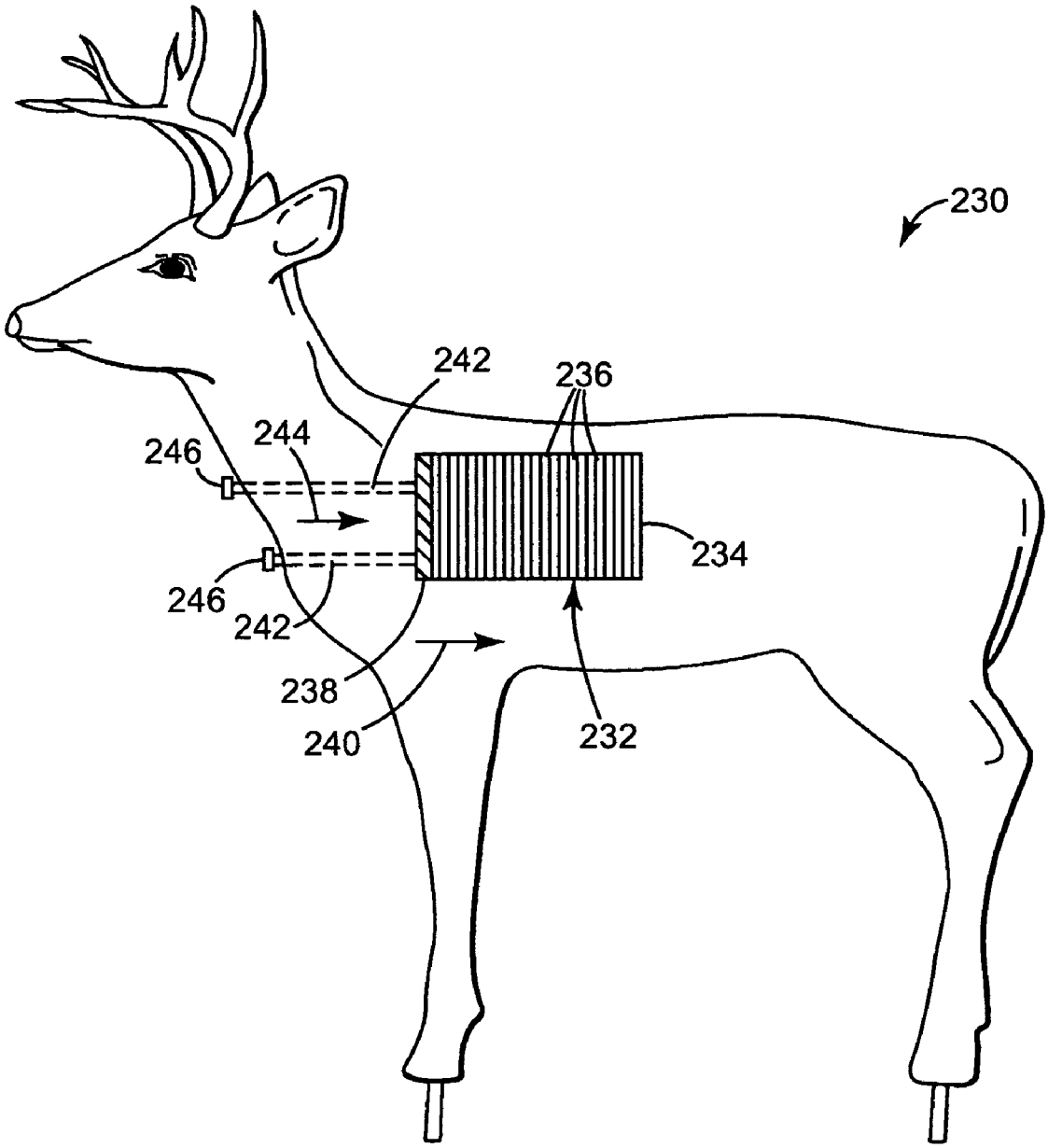
FIG. 9 illustrates an alternate mechanism for compressing the target elements in an archery target in accordance with the present invention.

FIG. 9 is a side view of an alternate three-dimensional archery target 230 in accordance with the present invention. The replaceable target assembly 232 is located in the chamber 234 with the target elements 236 oriented vertically. It is within the scope of the present invention to arrange the target elements 236 in any orientation. Plate 238 is displaced in a direction 240 by displacement mechanisms 242 so as to create compression force 244 on the major surface of the target elements 236. The compressive force 244 is opposed by the rear wall of the chamber 234. In the illustrated embodiment, the displacement mechanisms 242 include one or more knobs 246 located near the front of the archery target 230. The knobs 246 are easily turned to increase or decrease the compressive force 244 on the replaceable target assembly 232. The knobs 246 allow the user to reduce the compressive force 244 so that one or more of the target elements 236 can be replaced.

Figure 10:
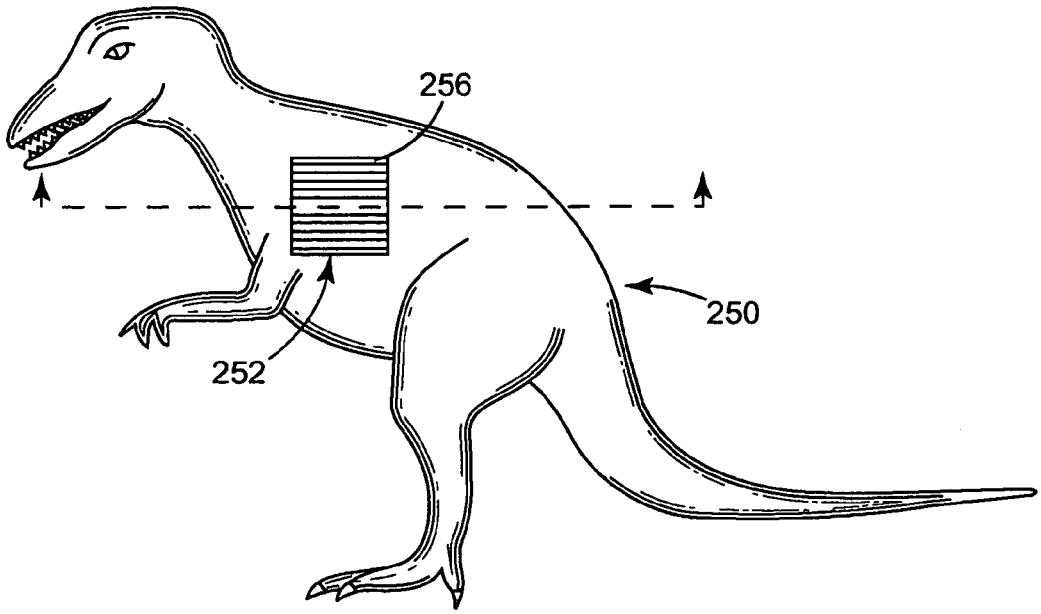
FIG. 10 is a side view of an alternate archery target in accordance with the present invention.
Figure 11:
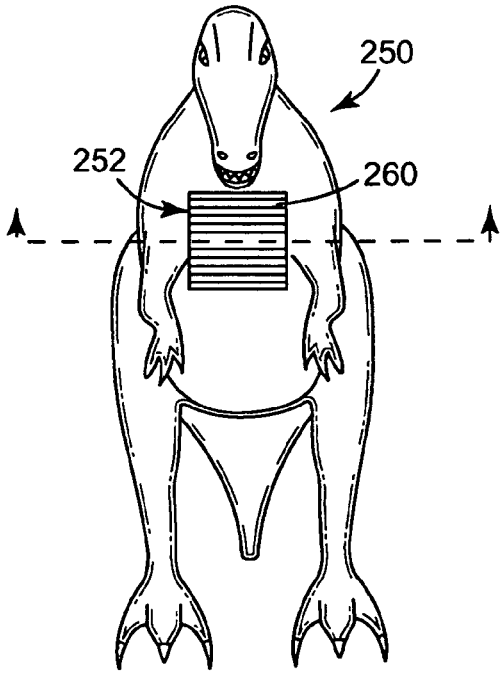
FIG. 11 is a front view of the archery target of FIG. 10.
Figure 12:
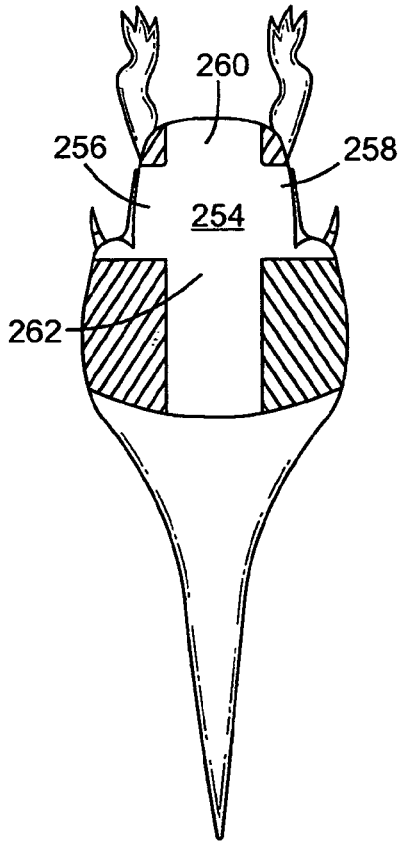
FIG. 12 is a sectional view of the archery target of FIGS. 10 and 11.

FIGS. 10 and 11 illustrate side and front views of an alternate three-dimensional archery target 250 in accordance with the present invention. As best illustrated in FIG. 12, the archery target 250 includes a single chamber 254 that is accessible through first and second target apertures 256, 258 along the sides of the archery target 250 and third and fourth target apertures 260, 262 located along the front and rear of the archery target 250. In the illustrated embodiment, a single replaceable target assembly 252 is preferably located in the chamber 254. Consequently, the user can launch arrows at all four sides of the archery target 250. Any of the target elements and displacement mechanisms disclosed herein can be used with the archery target 250.

FIGS. 13 and 14 illustrate an alternate replaceable target assembly 270 in accordance with the present invention. A plurality of target elements 272 is retained in a pre-compressed state by one or more bands 274. The bands can be metal, polymeric, natural fibers, or combinations thereof. Plates 276, 278 can optionally be located on the top and the bottom of the stack of target elements 272. The plates 276, 278 can be larger than, smaller than, or the same size and shape as the target elements 272. In the embodiment illustrated in FIGS. 13 and 14, the replaceable target assembly 270 includes a pair of opposing recesses 280, 282 which correspond to structures in the chamber of the three-dimensional archery target (see e.g., FIG. 4).

In another embodiment, the replaceable target assembly 270 is a continuous piece of homogeneous or composite material, such as foam, having the opposing recesses 280, 282, with or without the plates 276, 278. In yet another embodiment, the replaceable target assembly 270 is a plurality of pieces of material, such as foam, bonded together to form a single structure. Any of the target element shapes disclosed herein can be used in these various embodiments of the replaceable target assembly 270.

The replaceable target assembly 270 of FIGS. 13 and 14 are preferably pre-compressed so as to not require any additional compression by the three-dimensional archery target. Consequently, the replaceable target assembly 270 can be used with a wide variety of archery targets. On the other hand, an arrow strike can possibly cut the bands 274 and decompress the target elements 272, rendering the replaceable target assembly 270 inoperative. Additional, it is not possible to replace a single target element 272 without disassembling the entire replaceable target assembly 270. Rather, the whole replaceable target assembly 270 must be replaced. In an alternate embodiment, a pre-compressed version of the replaceable target assembly 270 is used in combination with compressive force provided by the three-dimensional archery target (see e.g., FIGS. 1, 7, 9).

FIGS. 15 through 18 illustrate various views of an alternate replaceable target assembly 300 with a covering layer 302 on the target faces 308, 310 in accordance with the present invention. As discussed above, the present replaceable target assembly 300 can be used as a freestanding archery target or as an insert for an archery target system, such as the three-dimensional archery targets discussed above. Consequently, the present replaceable target assembly 300 can assume any of the shapes disclosed herein or any other shape suitable for archery purposes.

Figure 17:
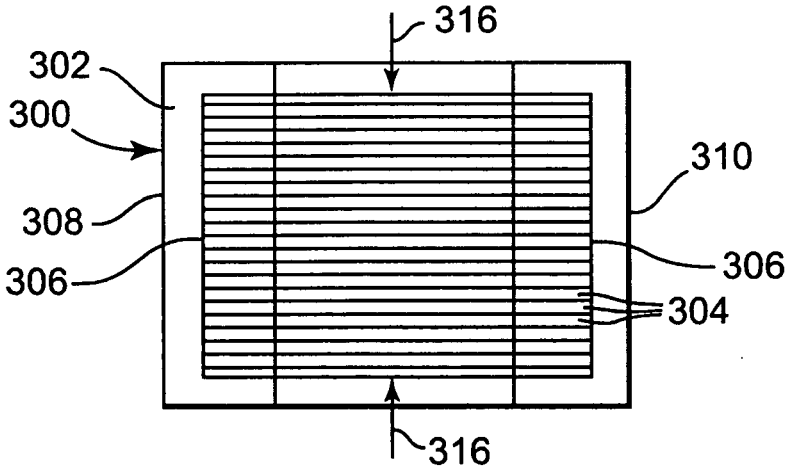
FIGS. 17 and 18 are sectional views of the alternate replaceable target assembly of FIGS. 15 and 16, respectively.

As best illustrated in FIG. 17, the replaceable target assembly 300 includes a plurality of target elements 304 preferably arranged in a stacked configuration. In the embodiment of FIGS. 15–18, the target elements 304 are generally planar. The covering layer 302 extends at least across the target faces 308, 310. In the illustrated embodiment, the covering layer 302 substantially surrounds the entire stack of target elements 304.

In the preferred embodiment, the covering layer 302 applies a compressive force 316 to the target elements 304. In an alternate embodiment, straps 364 or other mechanisms can be used to compress the target elements 304 prior to adding the covering layer 302 (see e.g., FIG. 21). For example, a three-dimensional archery target, such as illustrated in FIGS. 7 and 9, can be used to provide the compressive force to the replaceable target assembly 300, and hence, the target elements 304.

Planes containing the target elements 304 are preferably perpendicular to target faces 308, 310. Accordingly, the target elements 304 can be arranged vertically (see e.g., FIG. 9) or at any other angle an still have side edges 306 oriented generally toward the target faces 308, 310. In the embodiment of FIGS. 15–18, side edges 306 of the target elements 304 define a plane that is generally coplanar with the target faces 308, 310. The target elements 304 optionally have a shape generally corresponding to the cross-sectional shape of the replaceable target assembly 300.

Figure 18:
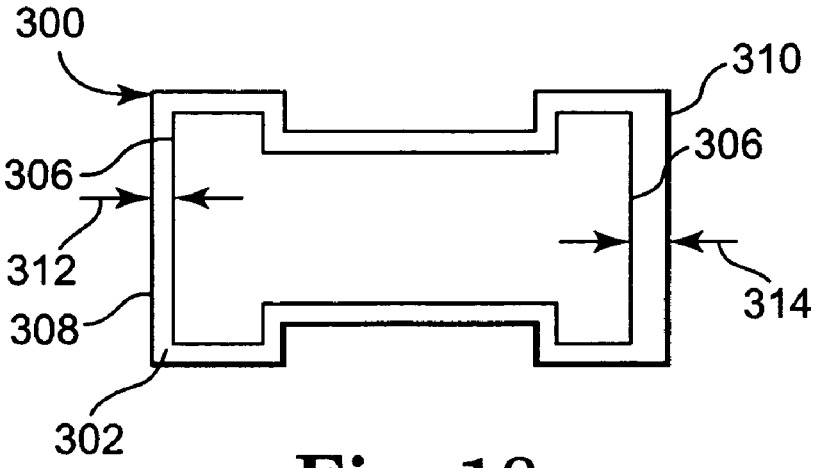

The covering layer 302 can have a uniform or variable thickness relative to the target elements 304. As illustrated in FIG. 18, the covering layer 302 has a first thickness 312 along target face 308 and a second greater thickness 314 along target face 310. The thicknesses 312, 314 can be engineered for different types of arrowheads and/or to simulate different types of game animals. The polymeric material forming the covering layer 302 can also be selected for these purposes.

Figure 19:
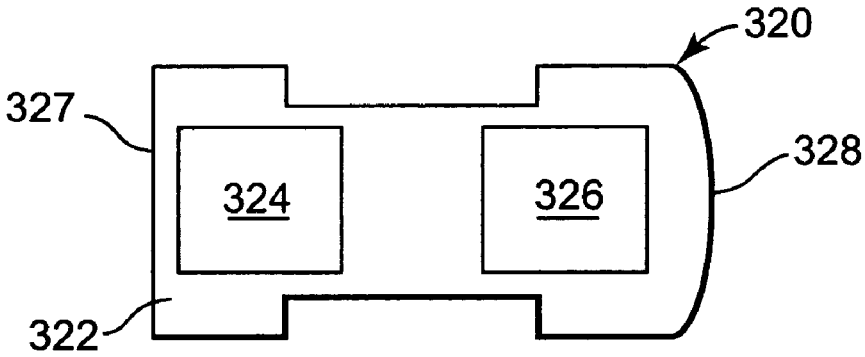
FIG. 19 is a sectional view of an alternate replaceable target assembly in accordance with the present invention.

FIG. 19 illustrates an alternate replaceable target assembly 320 with a covering layer 322 in accordance with the present invention. Two discrete stacks of target elements 324, 326 are substantially surrounded by the covering layer 322. The embodiment of FIG. 19 permits different types of target elements 324, 326 to be located in a single replaceable target assembly 320.

The target elements 324, 326 can differ in composition, density, thickness, cross-sectional geometry, and the like. For example, the target elements 324 can have a density of about 2 pounds per square foot and the target elements can have a density of about 10 pounds per square foot. As a result, arrow penetration in the target face 327 can be engineered to differ from arrow penetration in the target face 328, such as to simulate different game animals. Additionally, the shape of the target faces 327, 328 can differ. In the illustrated embodiment, the target face 327 is generally planar, while the target face 328 is curvilinear. Due to the polymeric nature of the covering layer 322, the surfaces comprising the target faces 327, 328 can assume any shape and/or any texture. The target faces 327, 328 preferably have a shape corresponding to the desired game animal.

Figure 20:
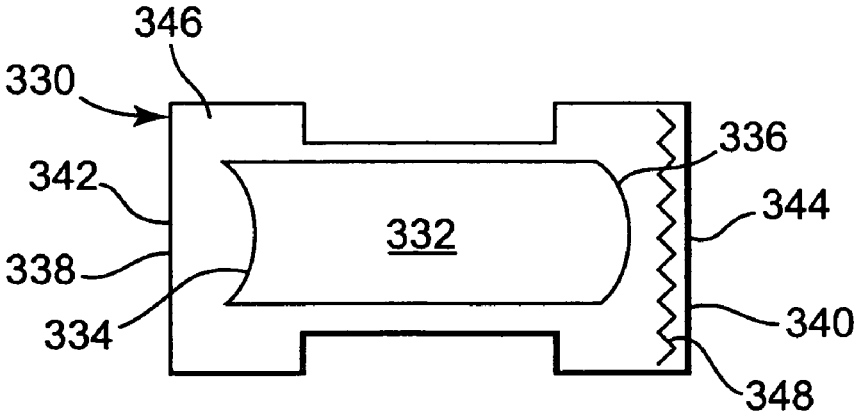
FIG. 20 is a sectional view of another alternate replaceable target assembly in accordance with the present invention.

FIG. 20 illustrates an alternate replaceable target assembly 330 with a covering layer 346 in accordance with the present invention. The target elements 332 have generally curved side edges 334, 336. Curved side edges 334 are concave and curved side edges 336 are convex. Due to the shape of the target elements 332, the thickness of the covering layer 346 varies across the target faces 338, 340. Along the target face 338 the covering layer 346 is thicker near center region 342, while the covering layer 346 along the target face 340 is thinner near center region 344. Varying the thickness of the covering layer 346 across the target faces 338, 340 is particularly suited to simulate arrow penetration for different game animals.

In one embodiment, reinforcing layer 348 is included in the covering layer 346. The reinforcing layer 348 can be attached to a surface of the covering layer 346 or molded into the material comprising the covering layer 346. Various reinforcing structures can optionally be included in the covering layer 346 such as fiberglass, woven and non-woven polymeric webs, and cellulose-based reinforcing webs. Example of such structures are disclosed in U.S. Pat. No. 5,055,242 (Vane); U.S. Pat. No. 5,910,458 (Beer); U.S. Pat. No. 5,286,553 (Haraguchi); U.S. Pat. No. 4,983,453 (Beall); and U.S. Pat. No. 6,080,482 (Martin).

Figure 21:
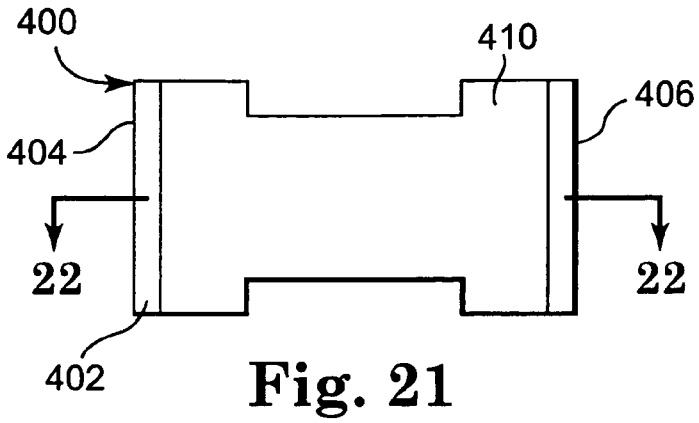
FIG. 21 is a top view of an alternate replaceable target assembly in accordance with the present invention.
Figure 22:
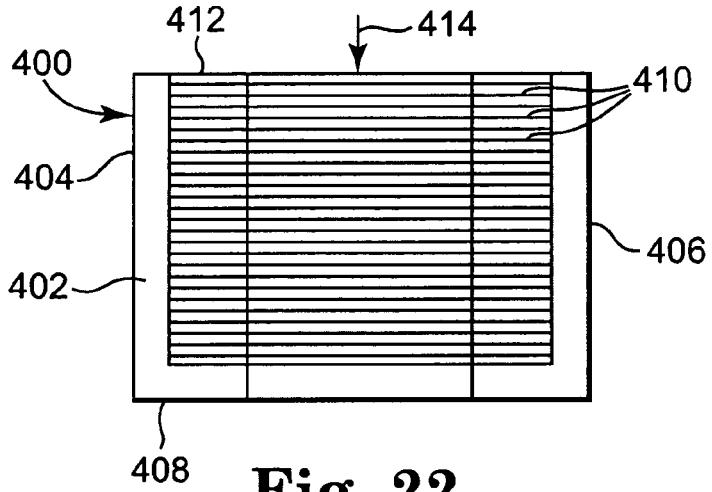
FIG. 22 is a sectional view of the alternate replaceable target assembly of FIG. 21.

FIGS. 21 and 22 illustrates an alternate replaceable target assembly 400 with a covering layer 402 in accordance with the present invention. In one embodiment, the covering layer 402 is located along target faces 404, 406 and along bottom surface 408 of the replaceable target assembly 400. In another embodiment, the covering layer 402 is located only on target faces 404, 406, not along bottom surface 408.

In the illustrated embodiment, target elements 410 are exposed along top surface 412 of the replaceable target assembly 400. This feature permits a compressive force 414 to be applied to the target elements 410, such as in one of the three-dimensional archery targets disclosed herein. Alternatively, the covering layer 402 can apply the compressive force 414 to the target elements 410.

Figure 23:
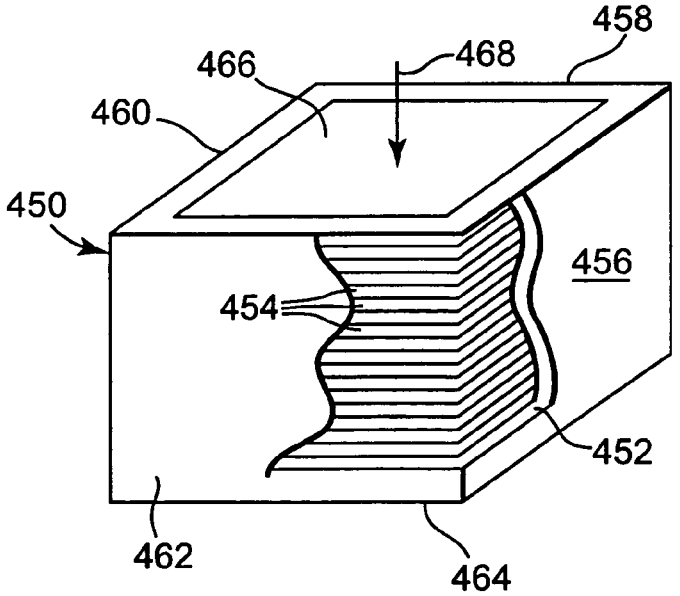
FIG. 23 is a perspective view of an alternate replaceable target assembly in accordance with the present invention.

FIG. 23 illustrates an alternate replaceable target assembly 450 with a covering layer 452 in accordance with the present invention. The replaceable target assembly 450 is configured as a solid, typically a cube or rectangular solid. Target elements 454 are arranged in a stacked configuration as discussed above. In the illustrated embodiment, the covering layer 452 extends along four sides 456, 458, 460, 462, and optionally, along the bottom 464. The covering layer 452 preferably does not extend along top surface 466.

Leaving the top surface 466 exposed permits compressive force 468 to be applied to the target elements 454 during application of the covering layer 452. Once the covering layer 452 is applied, it provides compressive force 468 to the target elements 454. Because the covering layer 452 grips the target elements 454 along the edges, the target elements 454 may bulge slightly in the center of the top surface 466.

In an embodiment without straps or other mechanisms to apply the compressive force 468 to the target elements 454, all four sides 456, 458, 460, 462 can serve as target faces. The replaceable target assembly 450 is particularly well suited to operate as a free-standing archery target. Any of the modifications and variations discussed herein can be incorporated in the replaceable target assembly 450.

Figure 24:
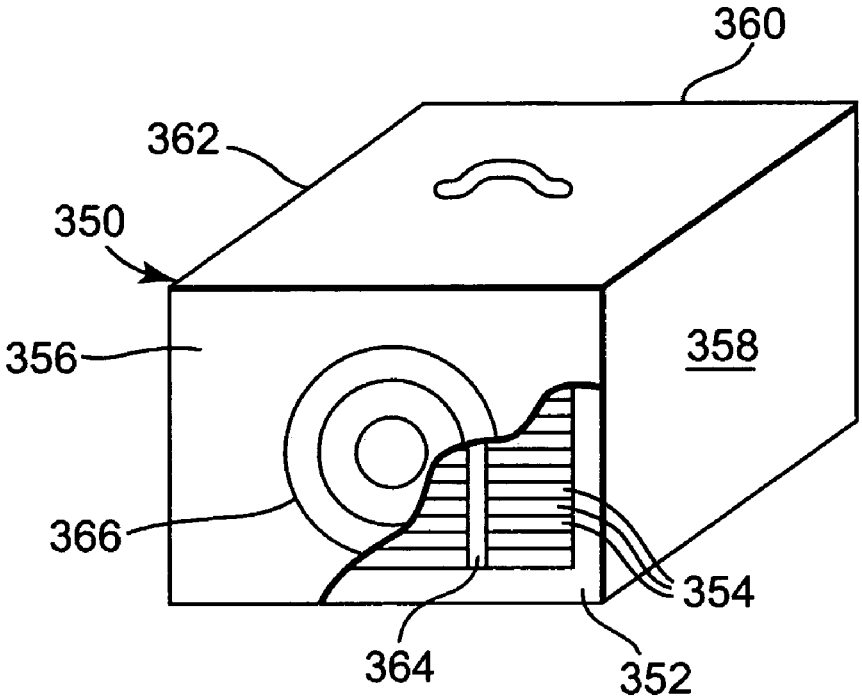
FIG. 24 is a perspective view of an alternate replaceable target assembly in accordance with the present invention.

FIG. 24 illustrates an alternate replaceable target assembly 350 with a covering layer 352 in accordance with the present invention. The replaceable target assembly 350 is configured as a solid, typically a cube or rectangular solid. A replaceable target assembly 350 with more than six sides can be constructed for selected applications. The target elements 354 are arranged in a stacked configuration as discussed above. In an embodiment without straps or other mechanisms to apply a compressive force to the target elements 354, the four sides 356, 358, 360, 362 can serve as target faces.

The covering layer 350 provides a flat and stable surface for applying indicia 366 to the replaceable target assembly 350. The indicia 366 can be for example concentric circle, an illustration of a game animal or portion thereof, an illustration of vital organs of a game animal, and the like. The indicia 366 can be applied using a variety of techniques, such as silk screening, printing, adhering a decal or appliqué, or a variety of other techniques known to those of skill in the art.

In an embodiment with optional straps 364, the sides 358 and 362 are typically the target faces. The replaceable target assembly 350 is particularly well suited to operate as a free-standing archery target. Any of the modifications and variations discussed herein can be incorporated in the replaceable target assembly 350.

Figure 25:
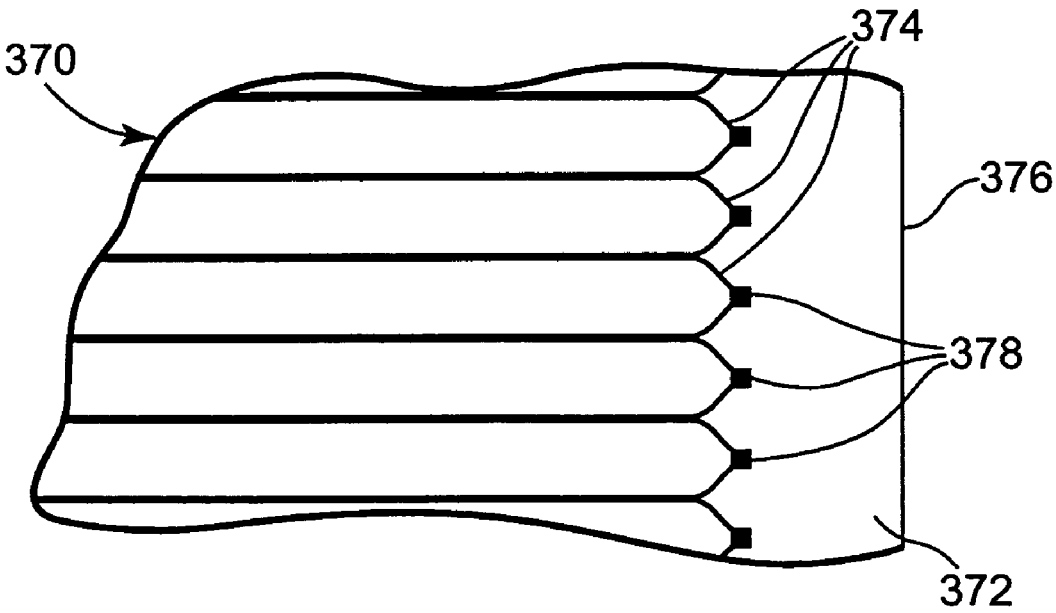
FIG. 25 is a sectional view of alternate planar target elements in accordance with the present invention.

FIG. 25 is an enlarged cross-sectional segment view of an alternate replaceable target assembly 370 with a covering layer 372 in accordance with the present invention. The side edges 374 opposite the target face 376 are compressed and deformed to create reduced profile edges 378. As used herein, a "reduced profile edge" refers to an edge with a thickness less than the nominal thickness of a target element. The reduced profile edges 378 are preferably formed by heat sealing, ultrasonically welding, and/or a variety of other techniques prior to application of the covering layer 372. The reduced profile edges 378 decrease the damage to the side edges 374 due to arrow strikes without diminishing the effectiveness of the archery target. The covering layer 372 also contributes a compressive force on the reduced profile edges 378.

As used herein, "covering layer" refers to a polymeric material extending substantially across at least one target face of a replaceable target element. The covering layer can optionally extend along other surfaces of the replaceable target element. In one embodiment, the covering layer extends substantially around the entire stack of target elements.

The covering layer is preferably compliant, deformable, resilient and at least partially self-healing. As used herein, "self-healing" refers to materials that when punctured or torn, tend to substantially reform or close after a short time. Materials possessing these characteristics are well suited to stand-up to repeated arrow strikes without substantial deterioration. The covering layer can be constructed from a thermoplastic or a thermoset material and may be porous or non-porous.

In one embodiment, the polymeric material is homogeneous. Various additives, fillers, colorants, and the like can also be added to the polymeric material.

The covering layer preferably bonds to the side edges of the target elements. In some embodiments, the covering layer will also bond to planar surfaces of the target elements. Bonding is enhanced by selecting a material for the covering layer that is compatible with target elements. As used herein, the phrase "compatible" in the context of a polymeric material refers to one selected or treated so as to facilitate penetration and/or essentially complete wetting of the surfaces of the target elements, provide desired physical properties of the cured or finished assembly, such a compliance, deformability, resilience and at least some self-healing properties, and is chemically stable when exposed to environmental conditions.

The covering layer of the present invention is preferably constructed from a polymeric material, such as for example polyethylene foam or polyurethane foam. The covering layer preferably has a thickness of at least 0.25 inches, more preferably at least 1.0 inch, and most preferably at least 2.0 inches. As discussed above, the thickness of the covering layer relative to the side edges of the target elements can vary along a single target face or between target faces.

The covering layer can optionally be molded to the stack of target elements. In one embodiment, the covering layer only extends along one or more target faces. In another embodiment, the covering layer substantially encapsulates the entire stack of target elements.

The polymeric material is optionally injected into a mold containing the stack of target elements under pressure so as to apply a compressive force to the target elements. The cured polymeric material acts as a tension member maintaining a compressive force on the target elements. In another embodiment, straps or other mechanical devices are used to compress the target elements before the polymeric material is introduced into the mold. In yet another embodiment, a compressive force is applied to the stack of target elements during injection of the polymeric material. Once the polymeric material is partially cured, the covering layer grips the edges of the target elements and maintains a compressive force.

In another embodiment, the covering layer is sprayed onto some or all of the surfaces of the stack of target elements. In some embodiments, shrinkage of the polymeric material during curing provides a sufficient compressive force on the target elements. In another embodiment, the polymeric material is subject to further processing after being applied to the stack of target elements, such as for example the application of heat and/or pressure. For example, in embodiments where the covering layer is constructed from a thermoplastic, the entire replaceable target element can be simultaneously compressed and heated. Once the covering layer cools, it will retain at least a portion of its compressed configuration, and hence, compress the target elements.

In yet another embodiment, the covering layer is one or more polymeric sheets bonded or laminated to at least the side edges of the target elements. The polymeric sheets can be bonded or laminated to one or both of the planar surfaces of the target elements as well. The polymeric sheets can be bonded or laminated using a variety of techniques, such as for example thermal bonding, adhesive bonding, ultrasonic bonding, solvent bonding, and the like. The polymeric sheets can optionally be self-supporting foam panels, films, non-woven webs, and the like. The seams between adjacent portions of the polymeric sheet materials are preferably sealed during the bonding process.

All patents and patent applications disclosed herein, including those disclosed in the background of the invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention. For example and although the target elements of uniformly thick layers is disclosed, differing thickness might also be incorporated into the target assembly.

What is claimed is:

1. An archery target comprising:

a plurality of target elements arranged in at least one stack, the target elements comprising side edges oriented toward a target face; and an uncured polymeric foam covering layer applied to the side edges, the foam covering layer generally following a contour of the side edges and extending in front of the side edges to comprise the target face, the uncured polymeric foam covering layer being subsequently cured and bonded to the side edges and adapted to form the target face with a contour independent of the contour of the side edges.

2. The archery target of claim 1 wherein the stack of target elements comprises a plurality of target faces.

3. The archery target of claim 1 wherein the polymeric covering layer substantially surrounds the stack of target elements.

4. The archery target of claim 1 wherein the polymeric covering layer substantially surrounds the side edges of the target elements to form a plurality of target faces.

5. The archery target of claim 1 wherein the polymeric covering layer provides a compressive force on the target elements.

6. The archery target of claim 1 wherein the covering layer comprises a generally uniform thickness relative to the side edges of the target elements along the target face.

7. The archery target of claim 1 wherein the covering layer comprises a first thickness relative to the side edges of the target elements along a first target face and a second thickness along a second target face.

8. The archery target of claim 1 wherein the covering layer comprises a generally variable thickness along the target face relative to the side edges of the target elements.

9. The archery target of claim 1 wherein the side edges of the target elements adjacent to the target face comprise a generally planar configuration.

10. The archery target of claim 1 wherein the side edges of the target elements adjacent to the target face comprise a generally curvilinear configuration.

11. The archery target of claim 1 wherein the stack of target elements comprises two discrete stacks of target elements.

12. The archery target of claim 11 wherein the discrete stacks of target elements comprise one or more different materials and/or different shapes.

13. The archery target of claim 1 wherein the target elements comprise a plurality of generally planar foam target elements.

14. The archery target of claim 1 wherein the side edges comprise reduced profile edges.

15. The archery target of claim 1 wherein the target elements comprise a foam material having a density selected in the range of about 2 pounds per square foot to about 10 pounds per square foot.

16. The archery target of claim 1 wherein the covering layer comprises a compliant, deformable and resilient polymeric material.

17. The archery target of claim 1 wherein the covering layer comprises a reinforcing structure.

18. The archery target of claim 1 wherein the covering layer comprises a thickness of at least 0.25 inches.

19. The archery target of claim 1 wherein the covering layer comprises a thickness of at least 1 inch.

20. The archery target of claim 1 wherein the covering layer is compatible with the material of the target elements.

21. The archery target of claim 1 wherein the covering layer comprises a self-healing material.

22. The archery target of claim 1 wherein the covering layer comprises a molded material.

23. The archery target of claim 1 wherein the covering layer comprises a homogenous material.

24. The archery target of claim 1 wherein the covering layer comprises a reinforcing material.

25. The archery target of claim 1 wherein the covering layer comprises a liquid coating applied to at least the side edges.

26. The archery target of claim 1 comprising straps surrounding the stack of targets elements.

27. The archery target of claim 1 wherein the archery target comprises a free standing archery target.

28. The archery target of claim 1 comprising indicia on at least one target face.

29. A three-dimensional archery target comprising a chamber containing the archery target of claim 1.

30. The archery target of claim 29 wherein the chamber comprises first and second generally opposing surfaces adapted to apply a compressive force to the target elements.

31. The archery target of claim 29 comprising one or more displacement mechanisms adapted to apply a compressive force to the archery target.

32. The archery target of claim 29 wherein the chamber comprises at least one surface adapted to mechanically couple with the archery target.

33. The archery target of claim 29 wherein the three-dimensional archery target simulates an animal.

34. An archery target comprising:

a plurality of planar target elements arranged in at least one stack, the stack of planar target elements subject to a compressive force on a major surface thereof, the target elements comprising a plurality of side edges oriented toward a target face; and an uncured polymeric foam covering layer applied to the side edges, the foam covering layer generally following a contour of the side edges and extending in front of the side edges to comprise the target face with a contour adapted to be different from the contour of the side edges, the uncured polymeric covering layer being subsequently cured and bonded to the side edges to form a cured foam polymeric covering layer providing at least a portion of the compressive force on the target elements.

35. A method of making an archery target, comprising the steps of:

arranging a plurality of target elements in a generally stacked configuration, the target elements comprising a plurality of side edges oriented toward a target face;

applying an uncured foam polymeric covering layer to encapsulate the stack of the target elements so that the foam covering layer generally follows a contour of the side edges, the foam covering layer extending in front of the side edges to comprise the target face, the uncured foam covering layer being subsequently cured and bonded to the side edges and adapted to form the target face with a contour independent of the contour of the side edges; and applying a compressive force on the target elements.

36. The method of claim 35 comprising locating a polymeric covering layer along a plurality of target faces.

37. The method of claim 35 comprising substantially surrounding the stack over target elements with the polymeric covering layer.

38. The method of claim 35 comprising substantially surrounding the side edges of the target elements with the polymeric covering layer and forming a plurality of target faces.

39. The method of claim 35 comprising applying a compressive force on a major surface of the target elements using the polymeric covering layer.

40. The method of claim 35 comprising applying the covering layer with a generally uniform thickness relative to the side edges of the target elements along the target face.

41. The method of claim 35 comprising applying the covering layer with a generally variable thickness relative to the side edges of the target elements along the target face.

42. The method of claim 35 comprising arranging the side edges of the target elements adjacent to the target face in a generally planar configuration.

43. The method of claim 35 comprising arranging the side edges of the target elements adjacent to the target face in a generally curvilinear configuration.

44. The method of claim 35 comprising arranging two discrete stacks of target elements in the archery target.

45. The method of claim 35 comprising arranging a first discrete stacks of target elements adjacent to a first target face and arranging a second stack of target elements adjacent a second target face.

46. The method of claim 35 wherein the target elements comprise a plurality of generally planar foam material.

47. The method of claim 35 comprising deforming the side edges of the target elements to create reduced profile side edges.

48. The method of claim 35 wherein the covering layer comprises a compliant, deformable and resilient polymeric material.

49. The method of claim 35 comprising locating a reinforcing structure in the covering layer.

50. The method of claim 35 wherein the covering layer comprises a thickness of at least 0.25 inches.

51. The method of claim 35 wherein the covering layer comprises a thickness of at least 1 inch.

52. The method of claim 35 wherein the covering layer is compatible with the material of the target elements.

53. The method of claim 35 wherein the covering layer comprises a self-healing material.

54. The method of claim 35 comprising molding the covering layer onto the side edges.

55. The method of claim 54 wherein the step of molding includes compressing the target elements.

56. The method of claim 35 comprising applying a liquid covering layer to the side edges.

57. The method of claim 35 comprising wrapping the target elements with straps.

58. The method of claim 35 comprising applying heat and/or pressure to the archery target to apply a compressive force on the target elements.

* * * * *